US005559395A

United States Patent [19]

Venkitasubrahmanian et al.

[11] Patent Number: 5,559,395

[45] Date of Patent: Sep. 24, 1996

[54] ELECTRONIC BALLAST WITH INTERFACE CIRCUITRY FOR PHASE ANGLE DIMMING CONTROL

[75] Inventors: Sreeraman Venkitasubrahmanian, Torrance, Calif.; Thomas Farkas, South Euclid, Ohio; Raj Jayaraman, Rancho Palos Verdes; Yongping Xia, Torrance, both of Calif.

[73] Assignee: Philips Electronics North America Corporation, New York, N.Y.

[21] Appl. No.: 414,859

[22] Filed: Mar. 31, 1995

[51] Int. Cl.[6] ..... H05B 37/02

[52] U.S. Cl. ..... 315/247; 315/307; 315/DIG. 4; 315/219; 315/209 R; 315/224

[58] Field of Search ..... 315/194, 247, 315/307, DIG. 4, 219, 209 R, 224

[56] References Cited

U.S. PATENT DOCUMENTS

| | | | |
|---|---|---|---|
| 4,251,752 | 2/1981 | Stolz | 315/247 |
| 4,277,728 | 7/1981 | Stevens | 315/247 |
| 4,392,086 | 7/1983 | Ide et al. | 315/174 |
| 4,492,897 | 1/1985 | Sairanen et al. | 315/219 |
| 4,523,131 | 6/1985 | Zansky | 315/247 |
| 4,651,060 | 3/1987 | Clark | 315/199 |
| 4,704,563 | 11/1987 | Hussey | 315/307 |
| 4,716,409 | 12/1987 | Hart et al. | 340/825.22 |
| 4,797,599 | 1/1989 | Ference et al. | 315/194 |
| 4,866,350 | 9/1989 | Counts | 315/209 |
| 4,950,959 | 8/1990 | Beckrot et al. | 315/DIG. 4 |
| 5,001,386 | 3/1991 | Sullivan et al. | 315/219 |
| 5,101,142 | 3/1992 | Chatfield | 315/308 |
| 5,192,896 | 3/1993 | Qin | 315/224 |

FOREIGN PATENT DOCUMENTS

| | | |
|---|---|---|
| 0030816 | 9/1983 | European Pat. Off. . |
| 0471215 | 2/1992 | European Pat. Off. . |
| 9014982.3 | 2/1991 | Germany . |
| 3116698 | 5/1991 | Japan . |
| 2154342 | 9/1985 | United Kingdom . |

OTHER PUBLICATIONS

Research Disclosure No.: 34878, Entitled: "Electronic Fluorescent Ballast Compatible With An Incandescent Lamp Dimmer". Dated before the invention thereof by applicant.

*Primary Examiner*—Robert Pascal
*Assistant Examiner*—Michael Shingleton
*Attorney, Agent, or Firm*—Brian J. Wieghaus

[57] ABSTRACT

A gas discharge lamp dimming ballast has a two wire input for connection to the hot dimmed and neutral leads of a phase control dimmer. The ballast has an improved topology in which a pre-conditioner supplies a substantially constant DC voltage to a ballast stage including an inverter, a resonant tank output and a control circuit. A dimming interface circuit derives a dimming signal having a voltage equal to the average value of the rectified output voltage of a full-bridge rectifier feeding the pre-conditioner circuit. The dim signal is independent of the DC rail voltage and, in combination with the maintenance of a substantially constant DC rail voltage, permits of improved dimming control while providing the ease of installation of a two wire ballast. The response time of the interface circuit relative to the pre-conditioner is selected to avoid power imbalances. The ballast also includes an EMI filter and circuitry to prevent capacitive hold-up by the EMI filter of the rectified voltage to preserve the conduction angle for the interface circuit.

28 Claims, 17 Drawing Sheets

TFWD TIME
MAX
STOP
IGN
PRE
DIM
MIN
IGNITION SWEEP
MAX LIGHT
NO-IGNITION
MIN LIGHT
TIME

LAMP VOLTAGE
VMAX
VSTOP

CP VOLTAGE

CRECT VOLTAGE
MAX LIGHT
Tpre
MIN LIGHT
END OF PREHEAT
IGNITION
STOP

ELECTRONIC BALLAST WITH INTERFACE CIRCUITRY FOR PHASE ANGLE DIMMING CONTROL

BACKGROUND OF THE INVENTION

1. Field of the Invention

The invention generally concerns lamp ballasts which are responsive to a phase angle controlled AC input to control the illumination level of gas discharge lamps. More particularly, the invention concerns an improved topography and dimming interface for a dimming ballast.

2. Description of the Prior Art

Lamp ballasts are known in which dimming of gas discharge lamps, typically fluorescent lamps, is responsive to phase angle control of the alternating current ("AC") power line input. Phase angle control involves the clipping of a portion of each half cycle of the AC sinusoidal power line voltage. A common type of phase angle controller, known generally as a forward phase dimmer, clips or blocks a portion of each positive or negative half cycle immediately after the zero crossing of the voltage. An example of a forward phase dimmer is the well known triac dimmer. Another type is the reverse phase dimmer, commonly known as an electronic dimmer, which passes the portion of the half-cycle immediately after the zero crossing and blocks the portion of the half cycle before the zero-crossing. In both types, the portion or angle of the half cycle which is blocked is adjustable.

JP-116698 discloses a ballast which responds to a phase controlled AC signal to vary the light level of a gas discharge lamp. The ballast has a pair of power line inputs which receive the AC mains voltage to power the ballast. The mains voltage is not phase controlled. A separate dimming input receives the hot dimmed output of the phase controller, which is the phase controlled AC waveform. A waveform shaping circuit converts the phase controlled AC signal into (i) a pulse width modulated ("pwm") signal having a pulse width corresponding to the conduction angle of the phase controlled dimming signal or (ii) a DC signal. Because the ballast has a dim input separate from the AC power line inputs, it is a three-wire device, i.e. it has a hot and a neutral AC input for powering the ballast and a separate hot dimmed input. DGM 9014982 shows a similar three-wire ballast with a separate input for the phase controlled dimming signal.

U.S. Pat. No. 4,797,599 (Ference et al) illustrates a power control circuit employing a master or control dimmer which provides a phase controlled input signal to one or several slave dimmers. The slave dimmers may be of a higher load capacity than the control dimmer, which permits the control dimmer to control higher loads than that for which it is rated. Ference '599 also discloses an external interface circuit employing this concept for connecting a master dimmer to an existing high frequency fluorescent dimming ballast which receives a known dim signal. The inputs of the interface circuit are the hot and neutral leads of the mains power supply as well as the dimmed hot output of the master controller which contains the phase controlled AC waveform. The outputs of the interface circuit are (i) a switched hot line which either provides source voltage or removes source voltage from the dimming ballast depending on the phase delay of the phase controlled waveform applied to the input of the interface circuit and (ii) a dim signal for input to the dimming ballast. The dim signal may be one of a pwm signal, a variable voltage, variable frequency or other signal as may be required by the ballast connected to the interface circuit. The inputs to the ballast are the switched hot lead and the dim signal carrying lead from the interface circuit and the neutral lead from the power line. The above system is a three wire system similar to that disclosed by JP-116698, with the difference being that the ballast receives a switched hot output from the interface circuit and the waveform shaping for the dim signal takes place in the interface circuit rather than the ballast itself.

Incandescent lamps are typically dimmed with a triac dimmer. The above three-wire ballasts employ a dimming input signal separate from the mains power supply. Such ballasts are inconvenient in that, when replacing incandescent lamps with a fluorescent lamp fixture, their installation requires the running of the additional, dim-signal-carrying wire between the controller, which is typically mounted in a wall, and the ballast mounted in the fluorescent lamp fixture in the ceiling. This results in considerable labor costs and is an impediment to market acceptance.

Lamp ballasts are also known which are two-wire devices in which the phase cut signal is not separate from the mains supply but is carried by the "hot" power line input. These are more attractive, from an installation standpoint, than the three-wire devices. U.S. Pat. No. 4,392,086 (Ide et al) discloses a ballast fed by a two wire phase control dimmer. The ballast includes an AC-DC rectifier, a high frequency inverter and an output transformer connected to the lamp. Dimming is achieved through voltage dimming, i.e. by reason of the input voltage to the inverter being reduced as a result of the phase cutting by the external triac dimmer. U.S. Pat. No. 5,192,896 (Qin) discloses another two wire dimming ballast which employs voltage dimming. The Qin '896 ballast includes an EMI input filter feeding a rectifier that supplies a DC voltage to a push-pull parallel resonant self-oscillating inverter. An output circuit includes an isolation transformer between the lamps and the inverter. The EMI filter has common and differential mode filter functions which reduces the level of high frequency interference being fed back into the power line and also improves the power factor. Because of the EMI filter, the Qin ballast will have a somewhat better power factor than that disclosed by Ide.

U.S. Pat. No. 4,866,350 (Counts) shows another two wire ballast responsive to a dimmer. The ballast is formed by a single integrated circuit which includes a high frequency oscillator and various control circuits. The ballast includes a compensator circuit which in response to the detection of a lower (dim) input voltage runs the oscillator at higher frequency. The higher frequency compensates for a reduced filament heating voltage and causes the lamps to remain lit at a lower intensity. While the inverter frequency changes to keep the lamps from extinguishing, dimming is primarily the result of the reduced input voltage to the inverter, and consequently is another form of voltage dimming. A disadvantage of this circuit is that the high frequency drive to the lamps is modulated on the 60 Hz AC input waveform. The ballast will have a high crest factor and power factor.

U.S. Pat. No. 4,449,897 (Sairanen) discloses yet another two wire dimming ballast. Sairanen's ballast has an EMI filter and discloses that at low conduction angles of the phase control input there is a danger that the EMI filter can cause misfiring of the triac in the phase angle controller when the EMI filter is not properly loaded. There is also the problem of an over voltage on the input buffer capacitor which feeds the inverter. To overcome this problem, Sairanen includes a switch which switches out the buffer capacitor when the lamp current is at low levels. As with the previous two-wire ballasts, the lamps are dimmed as a result of the reduced average input voltage caused by the triac dimmer.

U.S. Pat. No. 5,101,142 (Chatfield) discloses an electronic ballast for a compact fluorescent lamp with a high frequency inverter and a pre-conditioner circuit that provides active power factor correction. In the absence of phase angle dimming, the pre-conditioner also maintains a relatively constant DC bus voltage to the inverter. Because of the active power factor correction, the ballast will have a much better power factor in the absence of phase angle dimming than in the previously mentioned ballasts which had no or only passive power factor correction. The ballast is also dimmable via an external triac dimmer. During phase angle dimming a switch is opened to inactivate an error correction loop in the pre-conditioner, which error correction loop otherwise serves to maintain the DC bus voltage relatively constant. Inactivating the error correction loop permits the DC bus voltage fed to the inverter to be reduced in response to a reduced conduction angle of the mains voltage by the triac dimmer. A dimming interface circuit also receives the reduced bus voltage and provides a dim signal to a control input of a control circuit which controls inverter switching. In response to a lower DC bus voltage, the interface circuit provides a lower dim voltage to the control input, which lowers the duty cycle of the inverter, consequently lowering the net power input to the lamp.

A disadvantage of the Chatfield ballast is that the dimming signal is dependent on the voltage output by the active power factor correction circuit. Additionally, while the external dimming function is not clearly described in the '142 patent, it is believed that the disclosed arrangement has an effective dimming range limited to conduction angles less than 90 degrees, because as the conduction angle is increased above 90 degrees, the peak voltage seen by the preconditioner stays the same. Thus, the output voltage of the preconditioner remains the same above 90 degrees and consequently the derived dimming signal would remain the same. The effective dimming range would also be limited at low conduction angles by reason of the bus voltage dropping to low levels. Since the compliance voltage (i.e. the voltage needed to keep the lamp lit) increases with increased dimming, the lowering of the bus voltage at low conduction angles will be insufficient for the inverter and output circuit to maintain the compliance voltage. Thus, at low conduction angles the lamps will tend to extinguish.

Additionally, power factor correction circuits typically have a relatively slow reaction time to line variation. A reaction time of 100 ms is exemplary of the time necessary for the output voltage of the typical preconditioner to stabilize after a change in the mains input voltage. By contrast, commercially available phase angle dimmers can be changed between their high and low settings within about 30 ms. Accordingly, the dimming signal provided at the control input of the inverter driver is noticeably delayed by the preconditioner.

Accordingly, it is the object of the invention to provide a dimming ballast for a gas discharge lamp which overcomes the above mentioned disadvantages of the prior art.

SUMMARY OF THE INVENTION

Generally speaking, according to one aspect of the invention, a ballast for a gas discharge lamp has a pair of mains input terminals for receiving a phase-angle controlled AC mains voltage from a phase angle dimmer. A ballasting stage has a pair of DC inputs at which a substantially constant DC voltage is received, and a dim input, separate from the DC inputs, for receiving a dimming signal. The ballasting stage controls the electrical power supplied to the gas discharge lamp at a level corresponding to the dimming signal. A power supply circuit connected to the mains input terminals provides the substantially constant DC voltage to the ballasting stage. The ballast also includes circuitry for deriving a dimming signal from the phase angle controlled AC mains voltage and for supplying the dimming signal to the dim input of the ballasting stage. The derived dimming signal is independent of the DC voltage supplied to the DC inputs of the ballasting stage.

In contrast to the known two-wire dimming ballasts, the ballast according to the invention does not employ voltage dimming, i.e. a deliberate reduction in the DC rail voltage supplied to the ballast stage. By maintaining a substantially constant DC rail voltage, the ballasting stage can more readily control the illumination level of the lamps in response to the dimming signal than in the prior art two-wire ballasts in which both the dimming signal and the DC rail voltage input to the ballasting stage change simultaneously. Additionally, since the DC voltage input to the inverter does not decrease significantly as with the prior art two-wire ballasts for reduced conduction angle, but remains substantially constant, the increased compliance voltage necessary to keep the lamps lit at lower light levels is more readily achieved by the inverter for greater reductions in the conduction angle. Thus, the ballast topography according to the invention permits of a more precise control of the light level of the lamps over a large dimming range while maintaining the ease of installation and market acceptance of a two-wire ballast.

Favorably, the dimming signal supplied by the interface circuit is monotonically related to the conduction angle of the phase controlled AC mains voltage. The monotonic relationship permits of a simple correspondence between the setting of the phase angle dimmer and the control of the light level of the lamp to a corresponding level. In a preferred embodiment, the dimming interface circuit receives the rectified output of a full bridge rectifier which is connected to the input terminals and feeds the power supply circuit. This rectified DC voltage includes the phase control information (i.e. the conduction angle) in each half cycle. The dimming signal derived by the interface circuit is a voltage equal to the average value of the rectified line voltage. This voltage decreases monotonically as the input conduction angle is decreased with a phase angle dimmer from a minimum to a maximum setting and holds for both forward phase angle (triac) and reverse phase angle (commonly referred to as "electronic") dimmers. This approach is significantly different from Chatfield '142, in which the dimming signal is derived from the output of the pre-conditioner, and provides a dimming signal directly related to the conduction angle.

Another feature of the interface circuit provides a low crest factor (i.e. the ratio of the peak to the rms value of the lamp current). A low crest factor is desirable to prevent degradation of lamp life. The ballast stage is responsive to the dimming signal to adjust the lamp power, primarily through changing the lamp current. The disclosed ballast stage has a feedback control loop which is very fast, resulting in the lamp current closely following the dim signal.. The interface circuit has a filter selected to attenuate the 120 HZ rectified voltage so that the dim signal, and consequently the lamp current, has a sufficiently low 120 Hz ripple so that a crest factor of about 1.6 is achieved.

Another aspect of the invention relates to the response time of the interface circuit relative to that of the power supply stage and the ballast stage so as to avoid power imbalances. According to the invention, the response time of the interface circuit is at least as fast, to the same order of magnitude, as the response time of the supply stage. This prevents a power imbalance situation during a period when the conduction angle is rapidly decreased in which the ballast stage would still be drawing high power from the pre-conditioner, even though the average voltage input to the preconditioner has already dropped because of the reduced conduction angle. If the ballast stage lags behind the power supply stage in this manner, the DC rail voltage from the pre-conditioner will drop, possibly extinguishing the lamps, and also causing high peak currents. Selecting the response time of the interface circuit to be at least as fast, and preferably faster, than the pre-conditioner ensures that the power drawn by the ballast stage is always equivalent to or less than the power available from the pre-conditioner, thereby ensuring the maintenance of the DC rail voltage at a substantially constant level and the avoidance of high peak currents even during periods when the input conduction angle is rapidly decreased by the external dimmer. As used herein, the response time of a circuit is meant to be the time it takes for its output to reach 90% of its final value due to a changed input.

First and second dimming interface circuits are disclosed which incorporate a two-pole filter and a three pole filter, respectively, that satisfy the above requirements regarding signal attenuation and response time. It should be noted that while the Ference '599 patent discloses the use of a two pole filter, this filter was employed in an interface circuit which was external to and supplied a dimming signal to a three-wire ballast. Such a three-wire ballast has two inputs connected to the common and hot lines of the mains supply, and a separate dim input. Since the mains supply is constant and not altered by the dimming function, there is no recognition of the problem of power imbalances occurring in a two-wire ballast as in the present invention where the conduction angle of the AC mains supply is altered by the external dimmer.

According to another aspect of the invention, the ballast includes an EMI filter with a filter capacitor connected across the output of the rectifier and charged by the full wave rectified output of the rectifier. The power supply is a switched-mode power supply having a controllable switch switched at high frequency under control of a control circuit to maintain the DC level. In one of the switching states of the switch, the filter capacitor discharges. The control circuit maintains the high frequency switching of the controllable switch during all portions of each cycle of the rectified DC output voltage, and in particular, during those portions in which the voltage is at or near zero. This alleviates capacitive hold-up of the rectified DC voltage so that the rectified voltage waveform mirrors the phase controlled input. This preserves the conduction angle information for the interface circuit so that the voltage of the derived dimming signal more precisely corresponds to the conduction angle set by the external dimmer.

These and other objects, features and advantages of the invention will become apparent with reference to the accompanying drawing and the following detailed description and claims.

BRIEF DESCRIPTION OF THE DRAWINGS

FIG. 2(*a*) shows circuit A, B and C; FIG. 2(*b*) shows circuits D and E; and FIG. 2(*c*) shows circuit I;

FIG. 14(*c*) illustrates the full wave rectified voltage across rectifier outputs 13,18;

FIG. 14(*d*) illustrates the offset voltage sensed at the MULT IN pin of the IC U1;

FIG. 15(*b*) illustrates the same waveforms with misfiring prevented by the invention;

DETAILED DESCRIPTION OF THE PREFERRED EMBODIMENTS

Figure 1:
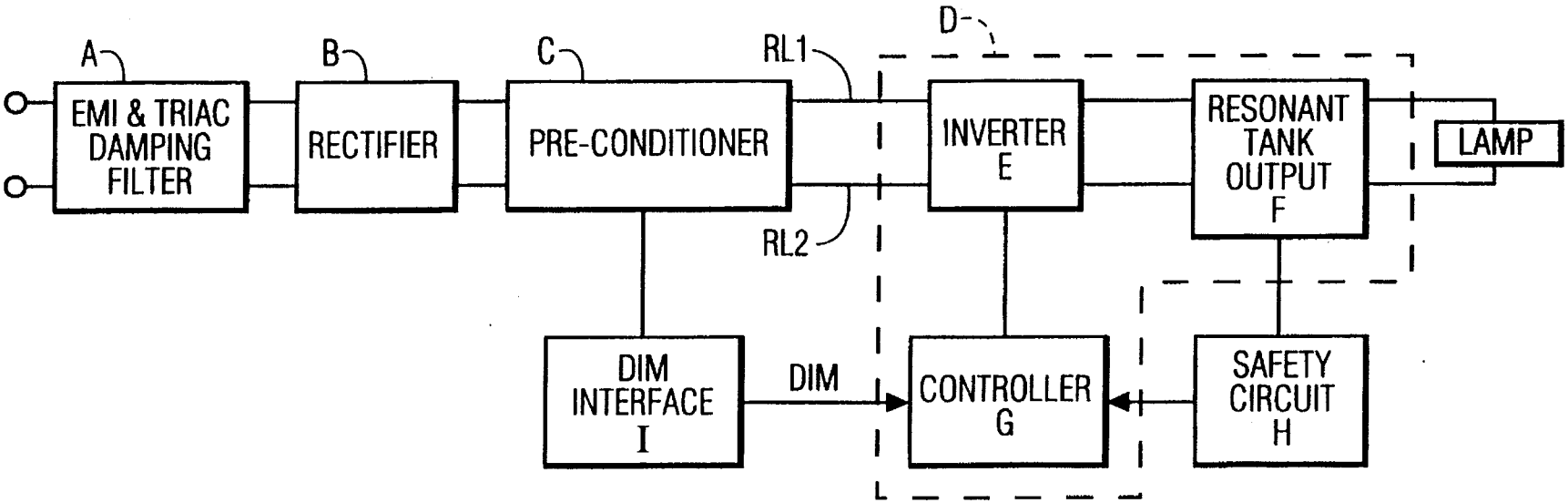
FIG. 1 is a block diagram of the ballast according to the invention.

The fluorescent lamp controller shown in FIG. 1 includes an EMI and triac damping filter "A" connected to full bridge input rectifier "B", which together convert an AC power line voltage into a rectified, filtered DC voltage at an output thereof. The pre-conditioner circuit "C" includes circuitry for active power factor correction, as well as for increasing and controlling the DC voltage from the rectifier circuit B, which DC voltage is provided across a pair of DC rails RL1, RL2. Circuit "D" is a ballast circuit for controlling operation of the lamp and includes a DC-AC converter, or inverter, "E", resonant tank output circuit "F" and controller "G" which controls the inverter. The inverter E is a half-bridge configuration which under control of the half-bridge controller, or driver, circuit G provides a high frequency substantially square wave output voltage to the output circuit F. The resonant tank output circuit F converts the substantially square wave output of the half-bridge into a sinusoidal lamp current.

The safety circuit "H" provides a back-up stop function which prevents an output voltage from being present at the lamp terminals when one or both of the fluorescent lamps has failed or has been removed from its socket. The safety circuit also restarts the controller G when its senses that both filament electrodes in each lamp are good.

A dimming interface circuit "I" is connected between an output of the rectifier circuit B and a control input of ballast circuit present at the controller G to control dimming of the lamp. The dimming interface circuitry provides a dimming voltage signal to the controller G which is proportional to the setting of the phase angle dimmer.

CIRCUITS A;B: EMI and Triac Damping Filter; Full Bridge Rectifier

Figure 2A:
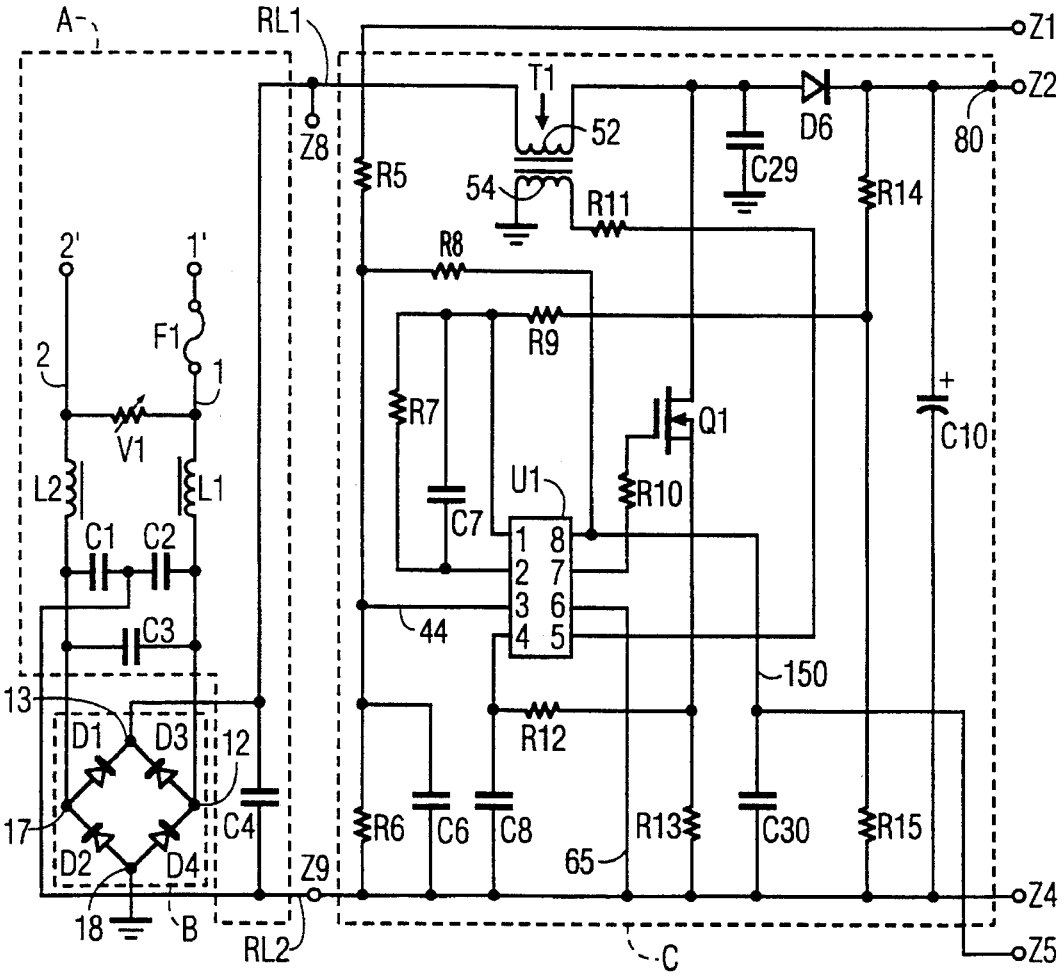
FIGS. 2(*a*)–2(*c*) show the detailed circuit diagram of the ballast of FIG. 1.
Figure 2B:
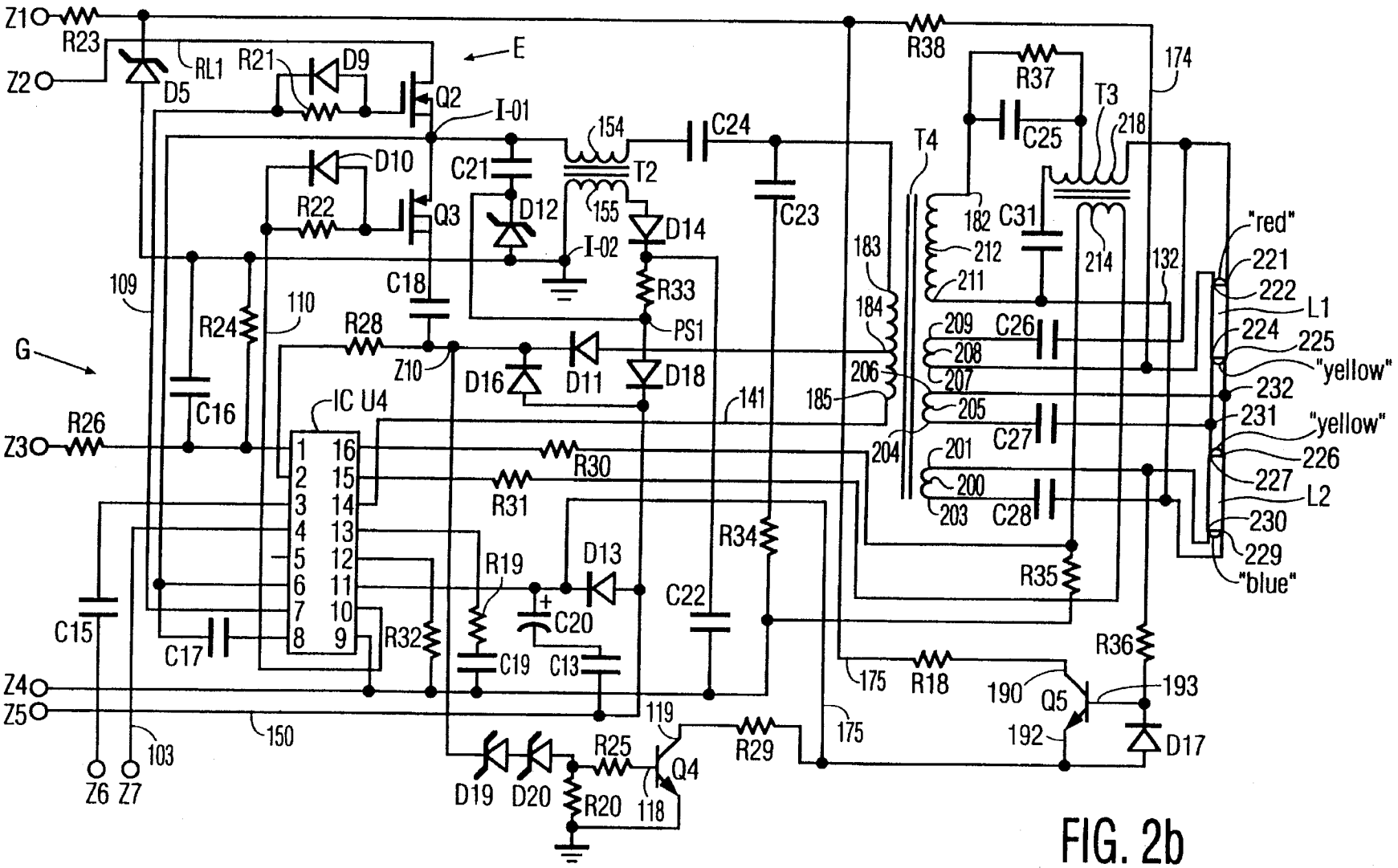
Figure 2C:
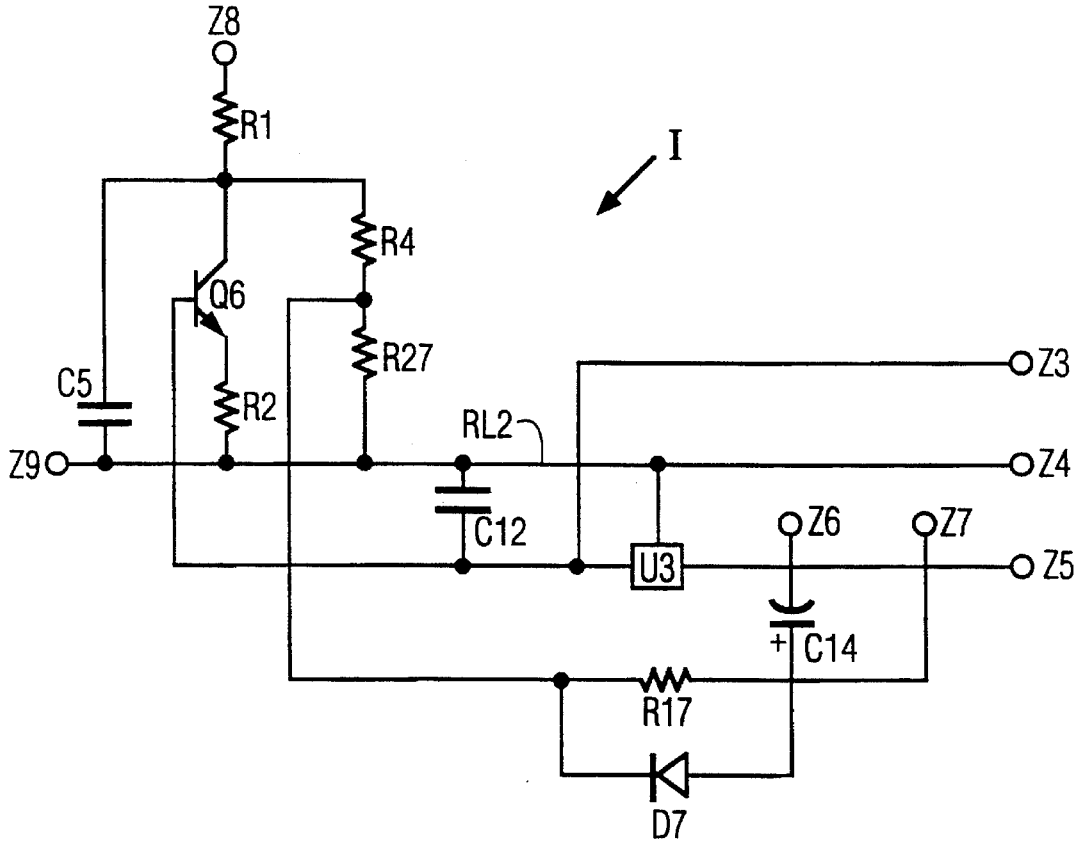

Filter Circuit A (FIG. 2(*a*)) includes a pair of input terminals 1',2' for receiving an ordinary alternating current power line voltage, for example, of 120 volts AC. First and second choke coils L1,L2 each have a first end connected to a respective terminal 1',2' and a second end connected to a respective input node 12,17 of the full bridge rectifier B, consisting of diodes D1–D4, via input lines 1,2. A fuse F1 is in series between the choke coil L1 and input terminal 1'. A transient-surge-suppressing metal oxide varistor V1 bridges the lines 1,2. The varistor conducts little at line voltage but conducts readily at higher voltages to protect the ballast from high transient surge voltages. The rectifier provides a full wave rectified output voltage on a pair of DC rails RL1, RL2 via nodes 13, 18, respectively. The cathode of diode D2 and the anode of diode D1 are connected to line 2 at node 17 and the cathode of diode D4 and the anode of diode D3 are connected to line 1 at node 12. The anodes of diodes D2 and D4 are connected to DC rail RL2 at node 18 and the cathodes of diodes D1 and D3 are connected to the DC rail RL1 at node 13. For a 120 V, 60 Hz AC input at terminals 1',2' the bridge rectifier outputs a pulsed 120 Hz DC, 170 V peak across rails RL1, RL2. The output of the bridge rectifier may also carry phase control information from an external phase control dimmer, to be further discussed.

Series capacitors C1 and C2, having their midpoint connected to ground, each have a relatively small capacitance and form a common mode filter which prevents very high frequency components from the ballast from entering the power line. The chokes L1, L2 and the capacitors C3, C4 form an EMI filter which has a low impedance at line frequencies and a high impedance at the much higher ballast operating frequency to reduce conduction of EMI back into the power lines. The operation of the EMI filter will be discussed in greater detail along with the interface and pre-conditioner circuits.

CIRCUIT C: Pre-Conditioner

Figure 3:
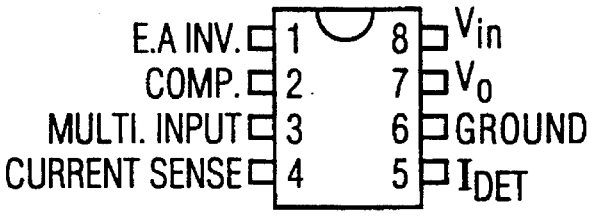
FIG. 3 illustrates the terminal pin arrangement for the IC U1 of the pre-conditioner circuit C.

The pre-conditioner circuit C (FIG. 2(*a*)) includes the primary components of an integrated circuit ("IC") control chip U1, in this instance an infinity LX1563, a boost inductor in the form of a transformer T1, a storage capacitor C10 and a boost switch Q1, which together form a switched mode power supply ("SMPS"). The controller U1 controls the switching of switch Q1 to (i) control the power factor of the current drawn from the power lines and (ii) increase the DC voltage across the capacitor C10, and rails RL1, RL2, to about 300 V DC. The pin connections for the IC U1, referred to below, are shown in FIG. 3.

Boost inductor T1 includes a primary coil 52 having one end connected to node 13 and another end connected to the anode of a diode D6. The cathode of the diode D6 is connected to an output 80 of the pre-conditioner circuit C. The anode of diode D6 is also connected to the drain of the mosfet switch Q1, the gate of which is connected to ground via a resistor R13. The control gate of switch Q1 is connected to the "OUT" pin (pin 7) of the IC U1 via a resistor R10. The OUT pin provides a pulse width modulated signal at the control gate of the boost switch to control the switching thereof. The multiplier input "MULT_IN" pin (pin 3) is connected to a node between the resistors R5 and R6 and senses the full wave rectified AC voltage on rail RL1, scaled by the voltage divider formed by the resistors R5, R6. The scaled voltage is one input of a multiplier stage within IC U1. The other input of the multiplier stage is internal and is the difference of an internal error amplifier output and an internal reference voltage. The output of the multiplier stage controls the peak inductor current in the primary of transformer T1 by influencing the timing of the switching of switch Q1. A capacitor C6 is in parallel with the resistor R6 and serves as a noise filter.

The "$V_{IN}$" pin (pin 8) receives the input supply voltage for the IC U1 from the output of the inverter circuit E via line 150. Since the output of the inverter is at high frequency, the bypass capacitor C30 provides a stable voltage supply. The "$V_{in}$" pin is also connected to a node between the resistors R5 and R6 via the resistor R8. This provides a small offset voltage to the MULT IN pin, which will be discussed in greater detail with reference to the EMI input filter. The secondary winding 54 of the booster choke T1 has one end connected to ground and its other end connected to the $I_{DET}$ pin (pin 5) via a resistor R11. The $I_{DET}$ pin senses the flyback voltage on the secondary winding 54 associated with the zero crossing of the inductor current through the primary winding 52. The GKD pin (pin 6) is connected to ground via line 65 and rail RL2. The C.S. pin (pin 4) senses the current through the boost switch Q1 by sensing the voltage drop across the resistor R13 through the resistor R12. A filter capacitor C8, tied between the rail RL2 and the C.S. pin, filters any voltage spikes which occur may upon the switching of the switch Q1 from its non-conductive to its conductive state due to the drain-to-source capacitance of mosfet Q1. A second voltage divider including the resistors R14 and R15 is connected between the rails RL1 and RL2. The "INV" pin (pin 1) is connected to a node between the resistors R14 and R15 via a resistor R9 and senses the output voltage of the preconditioner stage. The "COMP" pin (pin 2) is connected to the output of the internal error amplifier within IC U4. A feedback compensation network consisting of a resistor R7 and a capacitor C7 connects the COMP pin to the INV pin, thereby providing internal feedback and further control of the switch Q1.

The full-wave rectified positive DC voltage from the output 13 of the input rectifier, which may also carry phase control information from a remote dimming controller, enters the pre-conditioner circuit on rail RL1 to the voltage divider of resistors R5, R6 and to the booster choke T1. The DC component divides at lead 44 establishing a reference voltage to the multiplier input MULT_IN pin.

When the switch Q1 conducts, the resulting current through the primary winding 52 of transformer T1 and switch Q1 causes a voltage drop across the resistor R13 that is effectively applied through the resistor R12 to input C.S. This voltage at pin C.S. represents the peak inductor current and is compared with the voltage output by the internal multiplier stage, which multiplier output voltage is proportional to the product of the rectified AC line voltage and the output of the error amplifier internal to IC U1. When the peak inductor current sensed at pin C.S. exceeds the multiplier output voltage, the switch Q1 is turned off and stops conducting. The energy stored in the primary winding 52 is now transferred and stored in the boost capacitor C10, causing the current through the primary winding 52 to ramp down. When the primary winding 52 runs out of energy, the current through winding 52 reaches zero and the boost diode D6 stops conducting. At this point, the drain to source capacitance of the mosfet switch Q1 in combination with the primary winding 52 forms an LC tank circuit which causes the drain voltage on mosfet Q1 to resonate. This resonating voltage is sensed by the $I_{DET}$ pin through the secondary winding 54. When the resonating voltage swings negative, the IC U1 turns the switch Q1 ON, rendering it conductive. This conduction, non-conduction of switch Q1 occurs for the entire cycle of the rectified input and at a high frequency on the order of hundreds of times the frequency of the AC voltage entering the input rectifier. The inductor current through winding 52 has a high frequency content which is filtered by the input capacitor C4, resulting in a sine wave input current in phase with the AC line voltage. Essentially, the pre-conditioner stage makes the ballast look resistive to the power lines to maintain a high power factor.

For a 120 V AC input, without phase cutting, the voltage at output 80, the positive side of buffer capacitor C10, is on the order of 300 V DC with a small alternating DC component present. It is this voltage which is supplied to the ballast stage D, and in particular, to the inverter E. Output voltage regulation is accomplished by the sensing of the scaled output voltage, from the divider formed by the resistors R14, R15, by the internal error amplifier at the INV pin. The internal error amplifier compares the scaled output voltage to an internal reference voltage, and generates an error voltage. This error voltage controls the amplitude of the multiplier output, which adjusts the peak inductor current in winding 52 to be proportional to load and line variations, thereby maintaining a well regulated output voltage for the inverter circuit E.

Additional information about the LX1563 IC is available from Linfinity, Inc. of Garden Grove, Calif. 92641. It should be noted that other power factor control IC's are commercially available which provide substantially similar power factor control and voltage supply functions.

Circuit E: Inverter

The inverter (FIG. 2(*b*)) includes a pair of switches Q2 and Q3 which are arranged in a half-bridge configuration and convert the DC voltage from the pre-conditioner circuit to a high frequency substantially square wave AC output signal across the inverter outputs IO1 and IO2, under the control of control circuit G.

The switches Q2 and Q3 are mosfets. The drain of switch Q2 is connected via the rail RL1 to output 80 from the pre-conditioner circuit. The source of the switch Q2 is connected to the drain of the switch Q3. The control gate of the switch Q2 is connected via control line 109 to a respective gate controller terminal G1 (pin 7) of controller U4 of the control circuit via a parallel arrangement of a resistor R21 and a diode D9. The anode of the diode D9 is connected to the control gate of the switch Q2. The diode D9 and resistor R21 provide rapid evacuation of charges from the control gate to enhance switching speed. The control gate of the switch Q3 is similarly connected to gate control terminal G2 (pin 10) of IC U4 through line 110 via a similar parallel arrangement of a diode D10 and a resistor R22. Line 111 connects the midpoint I01 between the source of the switch Q2 and the drain of the switch Q3 to the controller circuit G and to one end of the capacitor C21.

Circuit G: Inverter Controller Circuit

Figure 4:
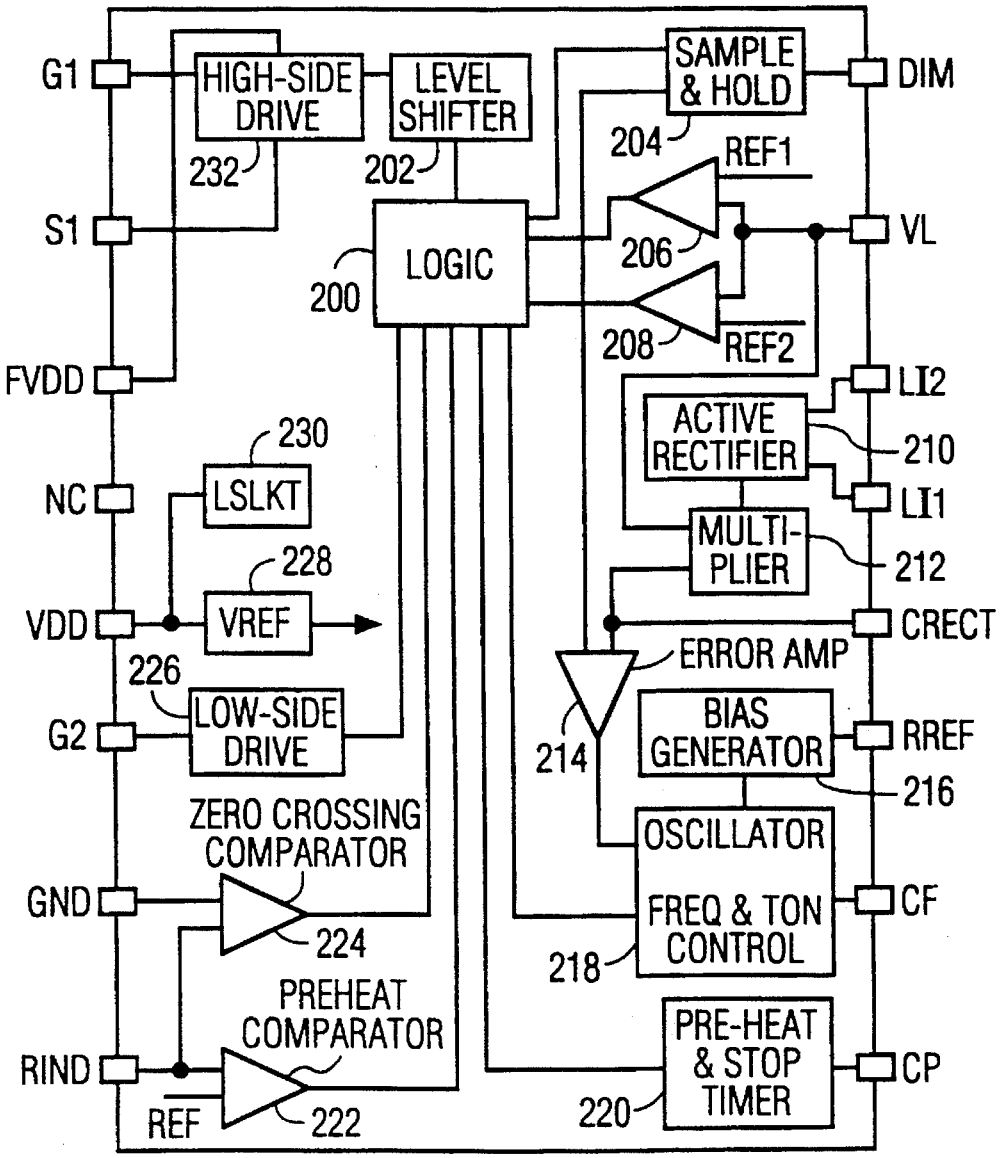
FIG. 4 is a block diagram of the IC U4 of circuit D.

The controller circuit G (FIG. 2(*b*)) controls the operation of the half-bridge inverter. The heart of the controller circuit is a 16 pin microcontroller U4, whose block diagram is shown in FIG. 4.

Figure 5:
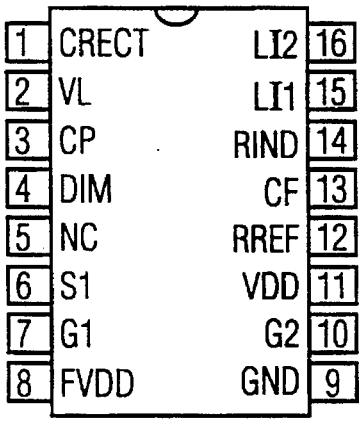
FIG. 5 shows the terminal pin arrangement for the IC U4 used in circuit D of FIG. 2(*b*)

The IC U4 contains a half-bridge driver for switches Q2 and Q3 as well as control circuits for preheat, ignition, on-state, dimming and protection. Dimming is achieved through closed loop control of a feedback sense of current and voltage down to 10% light level through the use of a semi-triangular oscillator used to implement forward conductance control. The various control circuits of IC U4, shown in FIG. 4 and identified with reference numerals 200–232, will be referred to in the following description of pin connections and in the discussion of half-bridge operation. The actual pin arrangement employed in the IC U4 of FIG. 2(*b*) is illustrated in FIG. 5.

Pin 1 (CRECT) is connected to a 5 V DC output of the voltage regulator U3 (FIG. 2(*c*)) via the resistor R26. The CRECT pin is connected to the output of multiplier 212 and provides a current that represents the lamp power into the CRECT capacitor C16 and RRECT resistor R24. The resistor R24 sets the gain of the multiplier 212 while the capacitor C16 filters the high frequency ripple in the CRECT output current and also determines the time from lamp ignition until full lamp power regulation. Pin 2 (VL) senses an averaged lamp voltage, via its connection to a tap on the primary winding 184 of transformer T4 of the output circuit F through a series connection of a resistor R28 and a diode D31, which is input to the multiplier 212 and error amps 206, 208. Pin 3 (CP) is connected to a timing capacitor C15, which sets the preheat time and stop timing duration of the preheat and stop timer 220. Pin 4 (DIM) receives a dimming control signal via line 103 from the dimming interface circuit, which dimming signal is applied the sample and hold circuit 204. Pin 5 remains unconnected. Line 111, which extends from junction I01 between the switches Q2 and Q3, is connected directly to pin 6(SI) and is connected to pin 8 (FVDD) via a bootstrap capacitor C17. Pin SI is a floating source pin for the high side driver 232 of switch Q2 while pin FVDD is the supply voltage pin for high side driver 232. The bootstrap capacitor C17 is charged by an on-chip diode during each time that switch Q3 is in the conducting state. Line 109, which is connected to the control gate of the switch Q2 via the parallel arrangement of resistor R21 and diode D9, is connected to pin 7(G1) the output of the high side driver 232.

Pin 9(GND) is connected to ground (rail RL2). Pin 10 (G2), the output of the low side driver 226, is connected to line 110, which is connected to the control gate of the switch Q3 via the parallel arrangement of the diode D10 and the resistor R22. Pin 11 (VDD) is the power supply input for IC U4 and is the voltage supply for the low side (ground level control) of the inverter. Pin 11 is connected to line 175 from the safety circuit H (to be further described) and to the high side of the VDD supply capacitor C20. Pin 13(CF) is connected to the rail RL2 through the series connected capacitor C19 and a resistor R19, which set the forward conduction "FWD" time of switch Q2, Q3 output by the oscillator and frequency control circuit 218. The capacitor C19 also sets the frequency of oscillation of the inverter. Pin 14(RIND) monitors inductor current through its connection to the end 185 of the primary winding 184 of transformer T4 to by a line 141. Pin 15(LI1) is connected to one side of a sense resistor R35 through a first input resistor R31, and pin 16 (LI2) is connected to the other end of sense resistor R35 through the identical resistor R30. Pins LI1 and LI2 sense differences in lamp current between the lamps L1 and L2, for the active rectifier 210, by means of the sense resistor R35 to which a bias current is applied by the secondary winding 214 of transformer T3.

Circuit F: Resonant Tank Output

The output circuit (FIG. 2(*b*)) provides a proper output voltage and current to the fluorescent lamps L1 and L2. The output circuit also provides filament heating for lamp ignition.

The output circuit has a first pair of output terminals 221, 222 for connection to a first pair of lamp contacts between which extends a first (hereinafter "red") filament of the lamp L1, a second pair of outputs terminals 234, 232 for connection to a respective pair of lamp contacts 224, 225 and 226, 227 on each of lamps L1 and L2 between which a second and third (hereinafter the "yellow") filaments extend, and a third pair of output terminals 229, 230 for connection to a respective pair of lamp contacts between which a fourth (hereinafter the "blue") lamp filament extends.

The output circuit includes an LCCR type resonant tank formed by the primary winding 154 of transformer T2, the DC blocking capacitor C24, the capacitor C23 and the lamp impedance reflected at the primary winding 184 of isolation transformer T4. The capacitor C24 blocks DC components of the inverter output voltage generated at node I01. Prior to ignition, the lamp impedance is very high so the Q curve is set primarily by the inductance of winding 154 and the capacitance of the capacitor C23. After ignition, the impedance of the lamps reflected at winding 184 of transformer T4 shifts the Q curve in the well-known manner.

The first ends of the first 154 and second 155 windings of the transformer T2 are connected via series arrangement of a zener diode D12 and a capacitor C21. The diode D12 and capacitor C21 form a so called dv/dt supply, and along with the zener diode D14 and the resistor R33 connected to the second end of the winding 155, a dual voltage supply at the node PS1 when the inverter is oscillating. A node between the cathode of the diode D14 and the resistor R33 is connected to ground (rail RL2) via a capacitor C22.

An iron core transformer T4 includes a primary winding 184 having one end 183 connected to the DC blocking capacitor C24. The other end 185 of winding 184 is connected directly to the RIND pin of IC U4 by line 141. A suitable voltage for igniting and operating the lamps L1 and L2 is provided by the secondary winding 212 of the transformer T4, which has one end 211 connected to the lamp contact terminal 229 via line 132 and its other end 182 connected to the lamp connection terminal 221 through a parallel arrangement of a resistor R37 and a capacitor C25, which arrangement is connected at a tap of a winding 218 of the transformer T3. The secondary winding 214 of transformer T3 provides a bias current for a sense resistor R35, which senses differences in lamp current between lamp L1 and L2.

Filament windings 200, 205 and 208 provide a current through the red, yellow and blue filaments, respectively, for filament heating. Filament winding 208 has one end 207 connected to the output terminal 222 and its other end 209 connected to output terminal 221 and to the end 219 of primary winding 218 of transfoiler T3 via a capacitor C26. Output terminal 232 is connected directly to one end 206 of the filament winding 205 and output terminal 231 is connected to the other end 204 of winding 205 via a capacitor C27. Output terminal 230 is connected to one end 201 of filament winding 200, the other end 203 of which is connected to output terminal 229 and the other end 211 of secondary winding 212 via a capacitor C28. The capacitors C26, C27, C28 serve to regulate changes in filament heating voltage, provide some impedance if the leads of filament windings are shorted, and aid the function of the safety circuit as will be further described.

Circuit H: Safety

The safety circuit H of FIG. 1 includes a stop circuit for stopping the oscillation of the half-bridge of the AC-DC converter in the event that one or both of the lamps is removed from the lamp contact terminals to prevent the presence of a dangerous voltage level at the lamp contact terminals. This is a back-up safety function in the event that the primary stop function provided by IC U4 fails to shut down inverter oscillation. The safety circuit H also includes a restart circuit for sensing when a lamp having two intact filaments has been inserted in place of a defective lamp and for restarting the IC U4 so as to operate the two fluorescent lamps.

Figure 6:
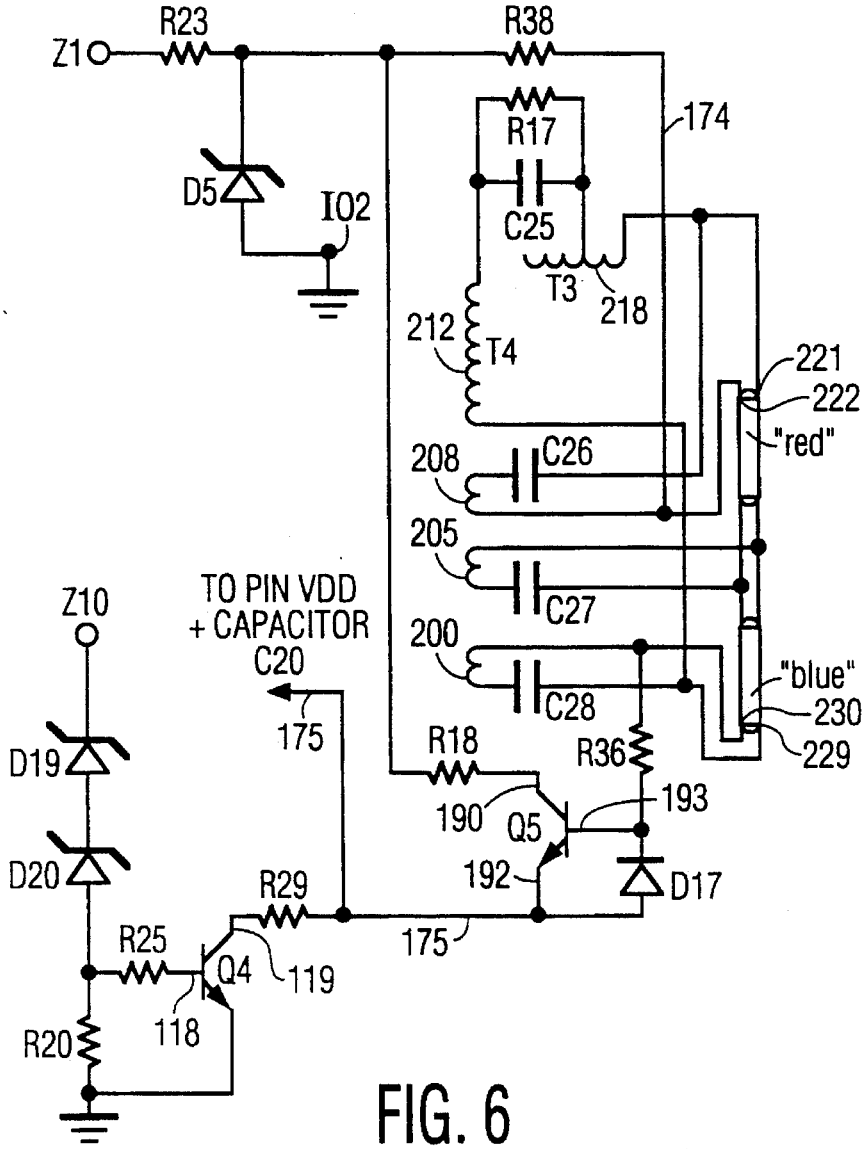
FIG. 6 is an isolated circuit diagram of the safety/start/restart circuit H.

The safety circuit included in FIG. 2(*b*) is shown isolated in FIG. 6 and includes switches Q4 and Q5, which are bipolar NPN transistors. The base 193 of the switch Q5 is connected to a junction between the end 201 of filament winding 200 and output terminal 230 via a resistor R36. The collector 190 of switch Q5 is connected through the resistor R18 to a junction between the resistors R38 and R23. A diode D17 has its cathode connected to the base 193 and its anode connected to the emitter 192 of the switch Q5. The emitter 192 is also connected via line 175 directly to pin VDD, the power supply pin for the microcontroller U4 and the ground level of the inverter. The resistor R29 is connected between the emitter 192 of switch Q5 and the collector 119 of switch Q4. The base 118 of transistor Q4 is connected to one end of a resistor R25, the other end of which is connected to a node between one end of the resistor R20 and the series connected zener diodes D19 and D20. Zener diode D20 is connected to node Z10 in the line which senses lamp voltage.

Ballast Operation Without Phase Control Dimming

When the ballast is turned ON, i.e. the power line voltage is applied to the input terminals 1', 2', a 120 Hz, 170 V peak fully rectified DC voltage is present at the outputs 13, 18 of the full bridge rectifier. (FIG. 2(*a*))

When two good lamps are present (i.e. both filaments in each lamp are intact), the IC U4 is supplied with power in the following manner. Current flows through the resistor R23 from the DC rail RL1. The zener diode D8 clamps the voltage at +25 V DC which is applied to the resistor R38, which causes a DC current to flow from line 174 through the red filament (in the direction from lamp connection terminal 222 to 221), through the winding 218 of the transformer T3, the resistor R37 and winding 212 of the transformer T4 and then through the blue filament (in the direction from lamp connection terminal 229 to 230). Current then flows through the resistor R36 to the base of transistor switch Q5, causing switch Q5 to conduct. The VDD supply capacitor C20 is then charged through the resistor R18 and line 175 so that a voltage is present at pin VDD which turns the controller U4 ON. After the inverter begins oscillating, discussed hereafter, the supply capacitor C20 remains charged through diodes D18 and D13 from the voltage supply at node PS1, previously discussed. (FIG. 2(*b*))

Initial Startup

Figure 7:
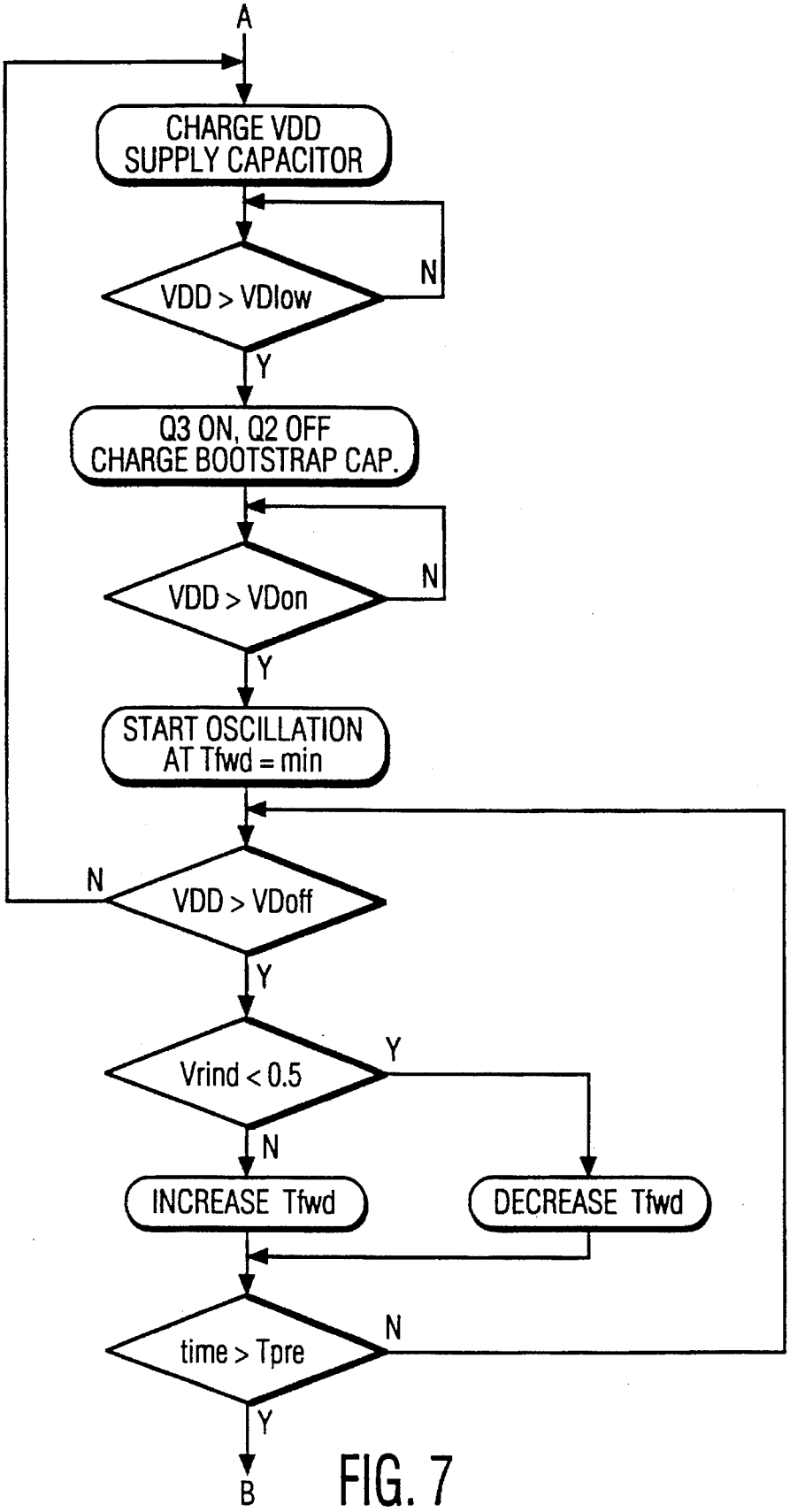
FIG. 7 is flowchart of the start-up and pre-heat stages for the controller U4.

A flowchart illustrating the start-up of IC U4 and of the pre-heat phase is shown in FIG. 7. Throughout the initial charging of VDD supply capacitor C20, which occurs for a voltage at pin VDD in the range of 0 V to a voltage "VDon" of about 12 V, the IC U4 is defined to be in a "startup" state. During the startup state, the IC U4 is in a non-oscillating condition and simultaneous conduction of Q2 and Q3 is prevented throughout this phase.

For the voltage at the VDD pin exceeding a level "VDlow" of about 6 V, switch Q3 will be on and switch Q2 will be off to ensure that the bootstrap capacitor C17 is charged through the internal bootstrap diode to a voltage level near VDD at the end of the initial charging phase. Also, the capacitor C19 tied to pin CF is charged to a level of "Vreg" of about 5 V at the end of the startup phase.

Oscillation

Figures 9A, 9B, 9C:
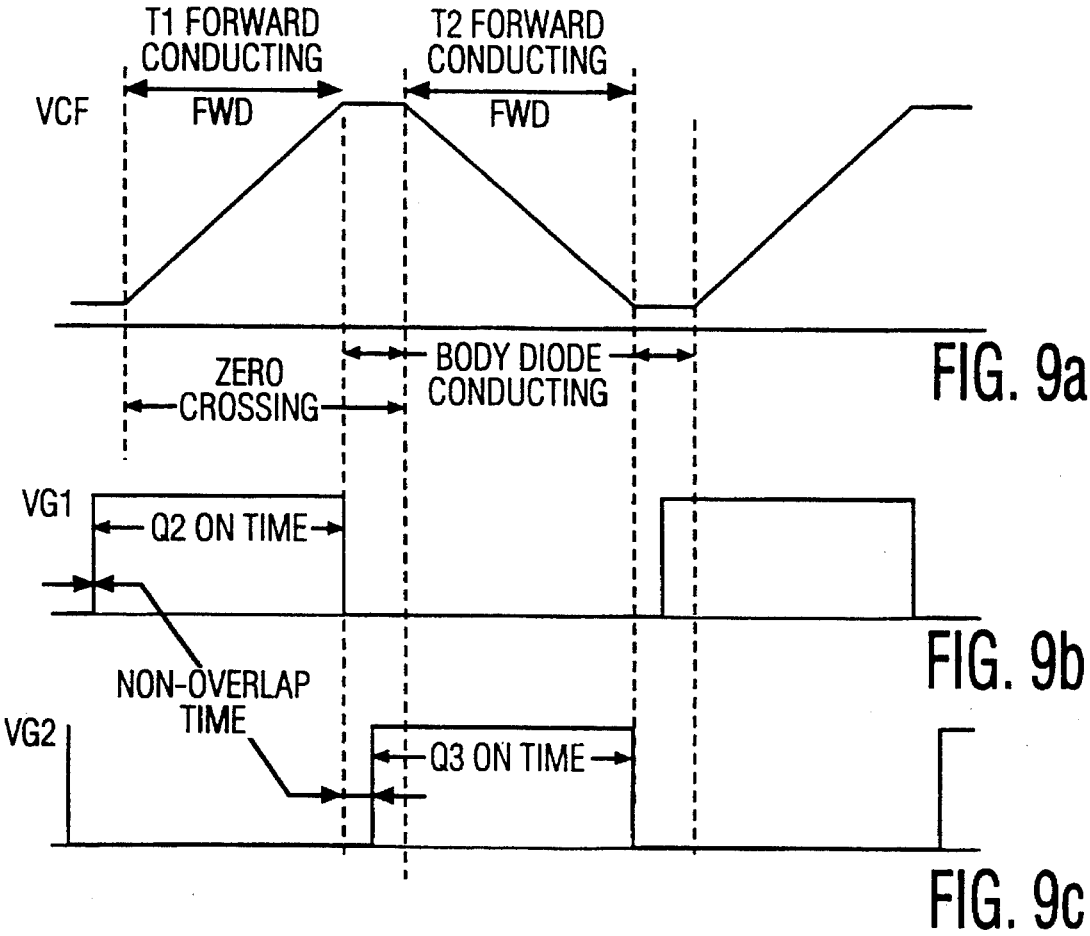
FIGS. 9(*a*)–9(*c*) shows three waveforms illustrating the forward conductance control outputs of the controller U4.

Once the supply capacitor C20 is charged to a value above Vdon, the IC U4 switches into the preheat state, and oscillation commences. The oscillator 218 via the logic circuit 200, level shifter 202, and the high 232 and low 226 side drives alternately switches transistors Q2 and Q3 into conduction with an identical forward conductance time FWD. (FIG. 9(*a*)) The duration of non-overlap between conductance of Q2 and Q3 (non-overlap time) is fixed at about 1.4 μs by the reference resistor R32. The oscillator normally operates in the forward conductance mode of control by implementing a semi-triangular voltage waveform "VCF" at the CF pin.

Given an inductive mode of operation of the half-bridge, the flat portion of the VCF waveform corresponds to body diode conduction (of the mosfets Q2, Q3) whereas the sloped portions coincide with actual transistor (forward) conduction. Forward conduction cannot start before the end of the non-overlap time. The duration of the sloped portions is the previously referred to "FWD" time. Moreover, the rising slope coincides with the forward conductance of the top half-bridge switch Q2 and the falling slope with the forward conductance of the bottom half-bridge switch Q3. The end of the body diode conduction is detected by a zero crossing at the RIND pin. The resulting semi-square wave half-bridge voltage VHB (See FIG. 11(*c*)) at half-bridge output I01 at pin S1 is then used to drive the resonant tank output circuit F.

Starting Oscillation

Once the supply capacitor C20 is charged above VDon, the oscillation begins by discharging the CF capacitor C19 which had been charged to Vreg during the startup phase. When the voltage at pin CF reaches a first level "VCF1" of about 1 V, switch Q3 is turned off, and the non-overlap timing is started. Following the non-overlap duration, switch Q2 is brought into the conducting state and the CF capacitor C19 simultaneously begins charging. Normally, the CF capacitor C19 begins charging only when a zero crossing is detected at the RIND pin. However, there is no guarantee that a zero crossing can be detected in the first switching cycle due to offsets in the comparator 224, so a non-overlap timer within circuit 218 is used to start the first FWD charging period at the CF pin. Following this first cycle, the RIND function works in the normal fashion.

Once oscillation begins, the same voltage present at supply node PS1 which charges the supply capacitor C20, is provided via line 150 to the VDD pin of the IC U1 and the pre-conditioner circuit commences operating in the manner previously described.

Forward Conductance Time Sweep and Preheat Control

Figures 10A, 10B, 10C, 10D:
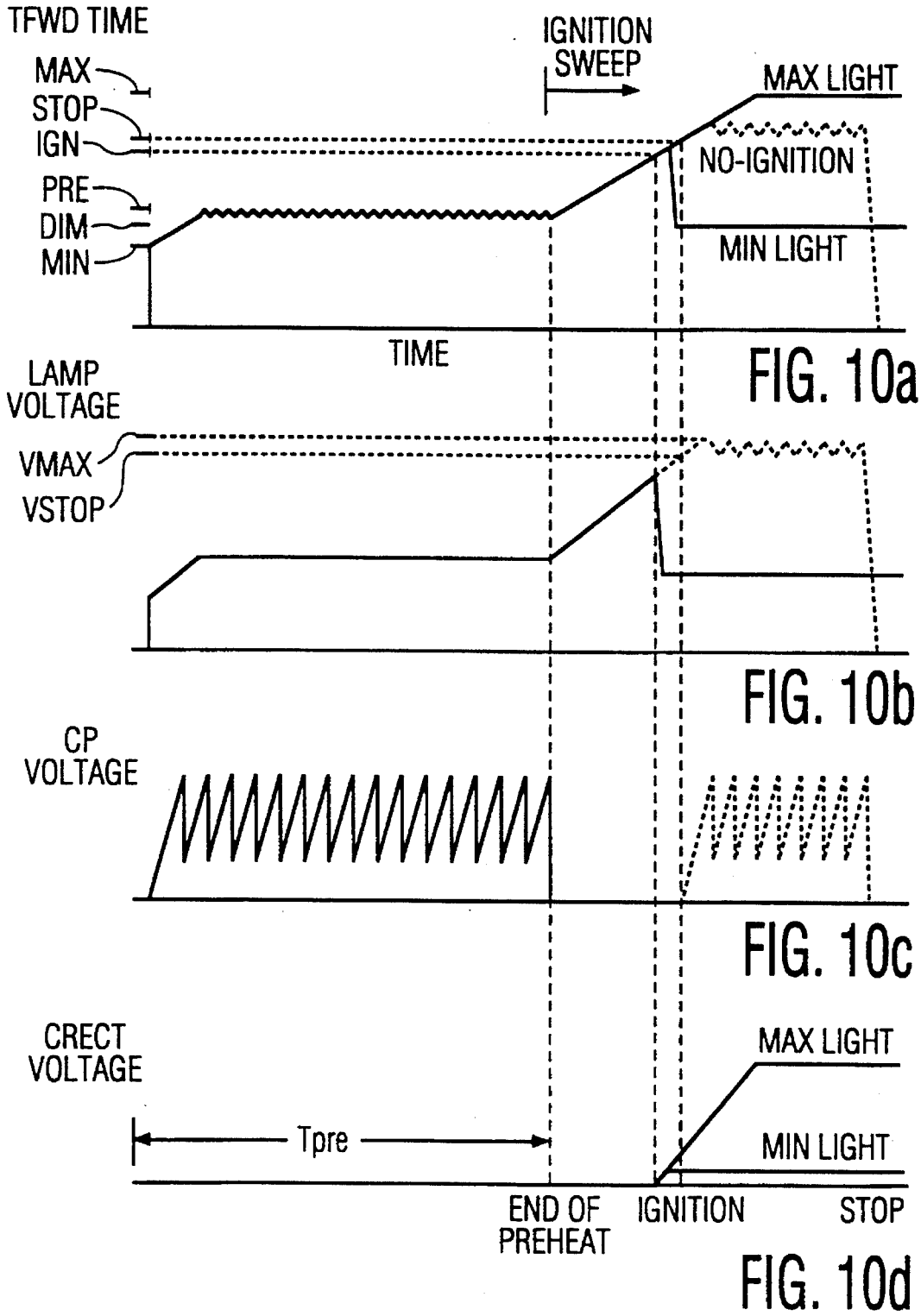
FIGS. 10(*a*)–10(*d*) illustrate waveforms for the pre-heat and ignition sequence.
Figure 11A:
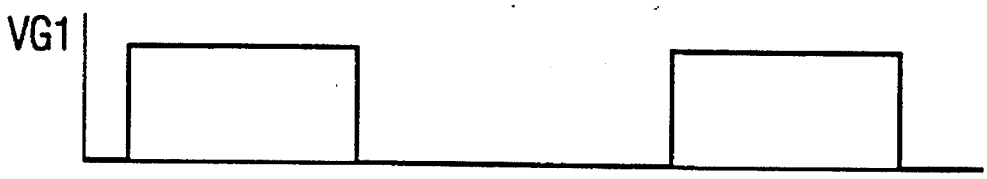
FIGS. 11(*a*)–11(*d*) show voltage waveforms on the gates of switches Q2 and Q3, the half-bridge node, and at the RIND pin of controller U4, respectively.
Figure 11B:
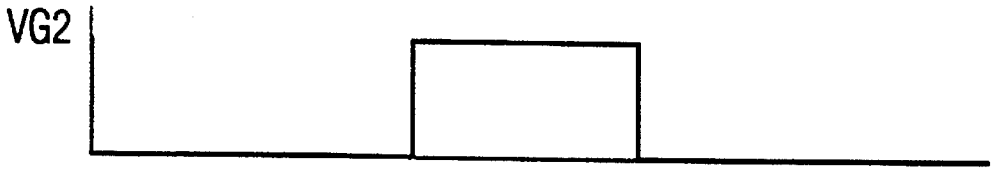
Figure 11C:
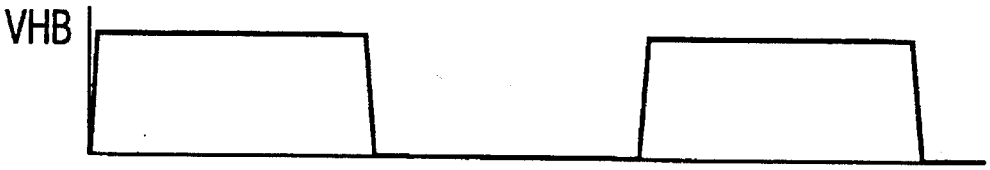
Figure 11D:
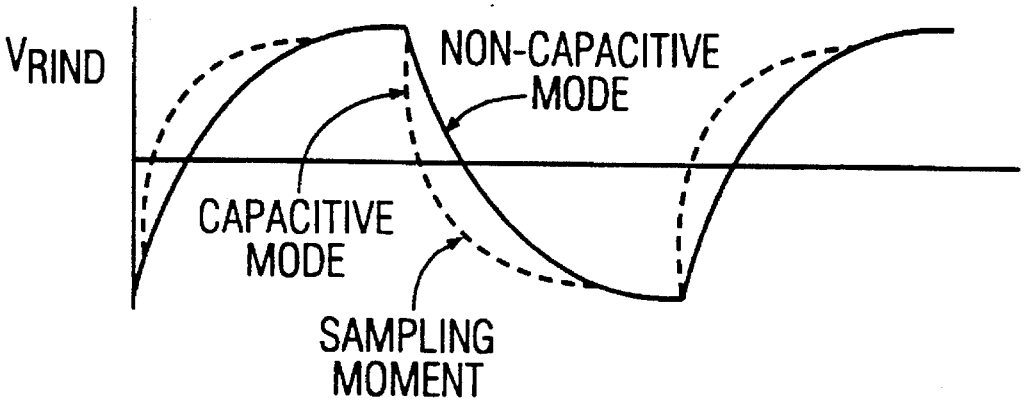

The IC U4 starts oscillation with the minimum FND time and gradually increase this time at a controlled rate equal to "SWPdwn" (see FIG. 10(*a*)). During the pre-heat stage, the preheat comparator 222 compares the voltage of pin RIND, resulting from the inductor current through the primary 184 of transformer T4, with a preheat threshold reference voltage "Vpre" of about −0.5 V. If the voltage sensed at the RIND pin is below Vpre at the time Q3 is switched off, the increase in FWD time stops and is then followed by a decrease in FWD time. This results in a regulated inductor current through the primary coil 184 of transformer T4, and consequently a regulated lamp electrode current, for the duration of the preheat cycle. In the present embodiment, the rate of decrease in frequency (or 1/FWD), "SWPdwn", is 0.017% per cycle; the rate of increase in frequency (or 1/FWD), SWPup, is equal to 3 times SWPdwn, both at a typical inverter frequency of 85 KHz during preheat (FWD time equal to 2.94 μs). The rate of increase and decrease in FWD time is fixed by an internal switched capacitor circuit within IC U4 which maintain a constant ratio independent of FWD time. The slope of the change in FWD time is also a fixed on-chip solution and cannot be changed externally.

Preheat Time

The preheat cycle begins at the instant oscillation starts and its duration, "Tpre", is determined by the capacitor C15 tied to the CP pin and the reference current set by the resistor R32 tied to pin Rref. In the current embodiment, Tpre is set at about 0.9 seconds. (FIG. 10(*d*))

FWD Sweep to Ignition

Figure 8:
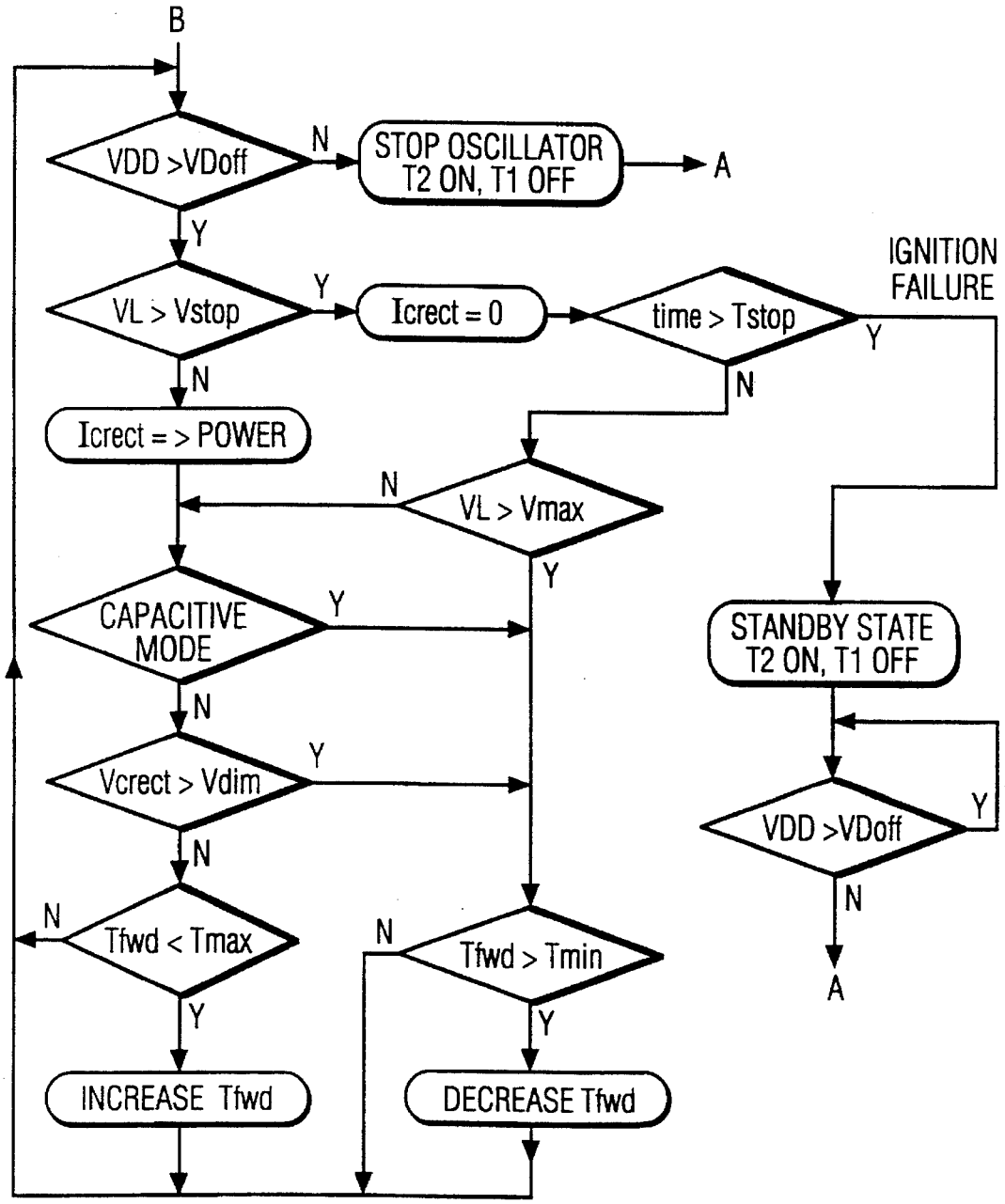
FIG. 8 is a flowchart for the ignition and normal operation stages of the controller U4.

The flowchart for ignition and normal operation is illustrated in FIG. 8. After the preheat time is over, the FWD time increases further, now without regard to the Vpre level at pin RIND. (See FIG. 10(*a*)) The rate of decrease in frequency (or 1/FWD) is equal to SWPdwn. During this upward sweep in FWD time the circuit approaches the resonance frequency of the load. Consequently, a high voltage appears across the lamp which normally results in lamp ignition. (FIG. 10(*b*))

Failure to Ignite

Failure of the lamp to ignite will be detected by sensing the rectified open circuit lamp voltage at pin VL. An averaged representation of the rectified lamp voltage, in the current embodiment from a tap on the primary 184, is fed as a current signal into Pin VL.

The logic circuit 200 includes a STOP function which is available at the instant ignition sweep starts and is present during normal operation. If the current into pin VL exceeds a level corresponding to a lamp voltage of Vstop, at the time Q3 is switched off, then the stop timing circuit 220 is activated and the output current from the CRECT pin is made zero. The stop timing duration, "Tstop", is set by the capacitor C15 tied to the CP pin and may be equal, for example, to about half of the preheat time. If the open circuit lamp voltage falls below Vstop before Tstop is exceeded, again at the time Q3 is switched off, then the lamp is considered to have ignited, the stop timing counter 220 is reset, and the multiplier 212 acts normally, feeding a current proportional to the product of lamp voltage and current into the CRECT pin. However, if the stop timing duration is completed, the lamp is considered to have not ignited. At the next conductance cycle for Q3, the half-bridge will be put into the non-oscillating or standby state. Only one ignition attempt is made. The Vstop level is chosen to be just above (+10%) the maximum lamp voltage under dimming conditions, which occurs at the lowest light setting. In the current implementation, Tstop, Vstop, and Vmax have been selected as ½ sec, 450 V, and 900 V, respectively.

If the current into pin VL exceeds a second defined level corresponding to an open circuit lamp voltage of Vmax, at the time Q3 is switched off and before time Tstop is exceeded, then the upward sweep in FWD time is stopped and is followed by a decrease in FWD time. When the open circuit lamp voltage drops below Vmax the downward sweep stops and is followed by an increase in FWD time. The rates of increase and decrease in frequency (or 1/FWD) are equal to SWPup and SWPdwn, respectively. This mode of dynamic lamp voltage regulation continues until the lamp ignites or the time Tstop is exceeded.

Standby State

The standby state is characterized by Q2 being off and Q3 being on, and the voltage at pin VDD being greater than VDoff. This state is exited by powering down the IC U4 (by removing the mains supply at input terminals 1',2'), and powering back up to above VDon. The standby state is also exited by the restart function of the safety circuit.

Normal Operation

After a normal ignition, the FWD time continues to increase at a rate equal to SWPdwn. However, since the lamp has ignited there is a large increase in lamp power which is detected by the lamp current and voltage sensing pins (L1 and VL), and converted into an output current at the CRECT pin which is proportional to the averaged lamp power. Consequently, the capacitor C16 tied to CRECT will start to charge from its initial value of zero volts up to a value equal to that at the DIM pin. The voltage at the DIM pin will be described in greater detail hereafter with reference to the dimming interface circuit. Once the voltages at pins CRECT and DIM are equal, the error amp 214 and the oscillator control 218 maintains their equality (thereby regulating the lamp power) by constantly adjusting the FWD time.

The delay from the moment of ignition to the time the lamp power reaches its regulated value is determined primarily by the charging time of the CRECT capacitor C16. With the dim level set at 100% light output, the FWD time continues to increase (at the rate SWPdwn) until the voltage at CRECT reaches its maximum value of 3 V and the feedback loop closes. (See FIGS. 10(*a*), 10(*b*)). With the dim level set at its minimum level, the CRECT capacitor only has to charge to about 0.3 volts before the feedback loop closes and drives the FWD time back down almost instantaneously to reduce the light level. As a result, the duration of the high light condition following ignition is very short for low dim settings, and the visual impact of the undesirable "light flash" is minimized.

Dimming

Dimming of the lamp is accomplished through the closed loop control of the average lamp power. The voltage at the CRECT pin, representing the average lamp power, is compared to the dimming reference voltage applied at the DIM pin. An internal high gain error amplifier 214 drives the FWD time of oscillator 218 until the difference between these two inputs is reduced to near zero, resulting in a linear and proportional control of the lamp power with the DIM voltage. The waveform at the DIM pin is internally sampled by the sample and hold register 204 during the last fourth of the falling sloped portion of the VCO waveform, and held just prior to the falling edge of the Q3 gate drive signal. The useful input range at the DIM pin for dimming control is between a maximum level of 3 V, and a minimum level of 0.3 V. Voltages greater than 3 V have the same effect as the maximum, and voltages less than 0.3 V are equivalent to the minimum. The lamp control loop is only closed following a successful lamp ignition. External changes in the DIM control voltage are set to be slower than the rate of change in voltage at the CRECT pin (set by the RRECT resistor R24 and CRECT capacitor C16).

Lamp Current Rectification

The active rectifier 210 (FIG. 4(*a*)) provides a full-wave rectified representation of the AC lamp current waveform for use in regulating the lamp power. It consists of a bipolar current amplifier, whose inputs are formed by pins L11 and L12, and an external resistor network including the sense resistor R35, and a pair of identical input resistors, R30 and R31. The AC lamp current is converted by this resistor network into a differential current, ILdiff, at pins LI1 and LI2. The output of the amplifier 210 feeds a current, which is equal to the absolute value of the differential input current, to one of the inputs of the multiplier circuit 212. Very low lamp current levels are accurately rectified and controlled by employing such an active circuit for the rectifier function.

The rectifier function operates in the following way. An AC lamp current flowing through the sense resistor R35 results in a proportional AC voltage across its terminals. Each end of the resistor R35 is connected through a respective input resistor, R30, R31, to one of the two input pins LI1, LI2. These pins act as current sources that maintain a zero difference voltage between the pins, and a common mode voltage given by:

$$V1i1=V1i2=\max(V1, V2)+R31*IL\text{bias}$$

where V1 and V2 are the voltages of the two ends of the sense resistor R35 and Ilbias is a bias current provided by the transformer T3.

With zero lamp current there is no voltage across R35 and consequently no difference in voltage between the two resistors R30 and R31. Consequently, the resistors R30, R31 will have identical voltage drops equal to R30*ILbias and R31*ILbias. When a lamp current is present, the voltage induced across R35 is also dropped across one of the resistors R30, R31 such that the current through it increases (by ILdiff) while the current through the other one remains at a constant value of ILbias. The output current from the active rectifier 210 is approximately equal to the absolute value of the differential input current which is given by:

$$IL\text{diff}=I\text{lamp}*R35/R31$$

Lamp Power Regulation

An on-chip multiplier 212 (FIG. 4(*a*)) generates the product of lamp voltage and current during normal closed loop operation. The averaged representation of the rectified lamp voltage is fed as a current signal into pin VL where it is applied to one input of the multiplier 212. A second input to the multiplier 212 is obtained from the output of the active rectifier 212. The product of the lamp voltage and lamp current is available as an output current at pin CRECT, where it is injected into the parallel network consisting of the RRECT resistor R24 and CRECT capacitor C16. The voltage at the CRECT pin provides a filtered representation of the average lamp power. CRECT capacitor C16 is also used to stabilize the feedback control loop. In a typical application circuit, the 3 to 0.3 V control range set by the DIM function results in an equivalent variation in the CRECT voltage (for a linear resistor at CRECT), and consequently in a lamp power range of 10:1 with a minimum light level of 10%.

Capacitive-Mode Protection

The IC U4 protects the inverter and output circuits against getting too close to a capacitive mode of operation. The voltage across the shunt resistor R34 is monitored by means of pin RIND. The state of the RIND pin is sampled at the start of conduction of either switch Q2 or Q3, and by checking the polarity of the signal a determination is made if the body diode of the respective switch is conducting. If the voltage at pin RIND is negative at the moment that switch Q3 is switched into conduction, then the body diode in Q3 has stopped conducting and the circuit is assumed to be close to or in capacitive mode. (FIG. 11(*d*)) Similarly, if the voltage at pin RIND is positive at the moment that Q2 is switched into conduction, the circuit is again assumed to be close to or in capacitive mode. Consequently, the logic circuit 200 will cause the oscillator and control circuit 218 to increase the frequency (or 1/FWD) a rate of SWPup for as long as capacitive mode is detected, and decrease at a rate of SWPdwn down to the regulated 1/FWD frequency if capacitive mode is no longer detected.

If a lamp is removed or fails after normal operation has commenced, the change of impedance reflected at the primary 184 of isolation transformer T4 will shift the Q-wave, and cause the inverter to enter a capacitive mode of operation. This will initially result in an increase in inverter frequency SWPup to the maximum frequency. The IC U4 will then enter the pre-heat and ignition procedure, leading to inverter shut-down due to Vmax being exceeded for a duration of Tstop.

Further Operation of the Safety Circuit

The safety circuit essentially requires that a DC current path extends through the red and blue filaments. The operation of the safety circuit has already been described for the start-up situation with two good lamps. As already discussed, the IC U4 has an internal STOP function which places the inverter in a standby state whenever the lamp voltage exceeds a predetermined level. When a lamp is removed or fails, then the lamp voltage sensed at pin V1 will exceed the preset stop level and the IC U4 will be put into the non-oscillating standby state.

The safety circuit H (FIGS. 2(*b*), 6) provides back-up shut-off protection to the STOP function which is internal to the IC U4. Whenever the voltage at node Z10 exceeds the voltage level corresponding to Vmax (of the IC U4 stop function) by about 10%, the zener diodes D19 and D20 will breakdown, allowing current to flow though the resistor R20 to ground. This renders the switch Q4 conductive, thereby draining the charge on the capacitor C20 to ground. This removes the voltage supply for the IC U4, turning IC U4 off and stopping inverter switching, resulting in switch Q5 switching back off.

The safety circuit also ensures that VDD power is resupplied to the IC U4 when the failed lamp has been replaced by a lamp with good filaments, to thereby restart the IC U4 and inverter oscillation, when the mains supply is maintained at the input terminals 1',2' during replacement of the failed lamp. When the failed lamp is replaced with a lamp having two good filaments, the DC current will again flow through the blue and red filaments, causing the controller U4 to turn ON and cause the DC-AC converter to output a high frequency signal to the output circuit.

The circuit shown in FIG. 6 may not always prevent VDD power from being supplied to IC U4 if either of the red or blue filaments is broken, or either of the lamps is not present, during initial application of power to the input terminals 1',2'. If, for example, the blue filament has failed or is not present, current flow through line 174 will not be able to pass across terminals 222-221. However, since the ballast was initially off, the capacitor C26 will have no charge initially. The current in line 174 will thus tend to charge the capacitor C26, providing a current path through the winding 218 of transformer T3 and the remaining parts of the DC path previously described to render Q5 conductive, allowing charging of the VDD capacitor C20. The same effect will occur for initial charging of the capacitor C28 if the red filament is broken or not present during initial application of power to the input terminals 1',2'. Thus, it is possible for a voltage to appear at the output for the first ½ sec after ballast turn-on (Tstop) even if a lamp is not present. The isolation transformer T4 provides substantial protection against shock hazard in this event.

Figure 12A:
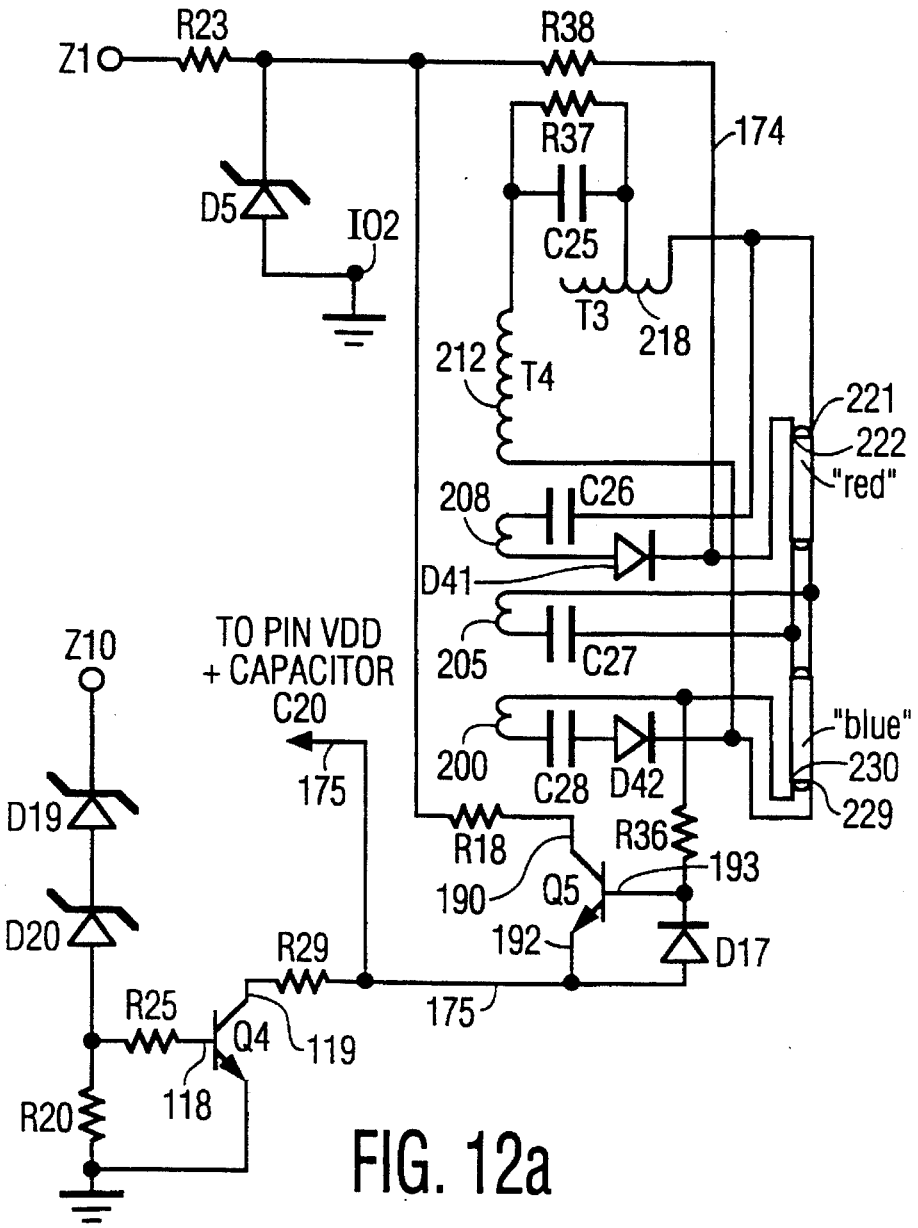
FIG. 12(*a*) is a circuit diagram of a second embodiment and FIG. 12(*b*) is an isolated view illustrating a third embodiment of the safety circuit H, each which prevents initial power-up of the IC U4 in the absence of lamps in the lamp terminals.
Figure 12B:
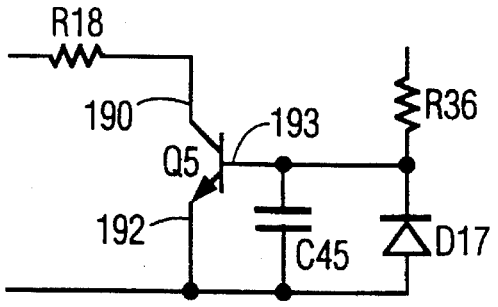

Still a further layer of safety is provided by preventing the VDD power from being initially supplied to the IC U4 when either of the lamps is missing or the red and blue filaments are broken. As shown in FIG. 12(*a*), a diode D41 is placed in series with the capacitor C26 and a diode D42 is placed in series with the capacitor C28. The diodes prevent DC current flow in the direction of the capacitors C26 and C28 when the red and blue filaments are broken or not present. This in turn prevents the switch Q5 from being rendered conductive, thereby preventing initial charging of the VDD supply capacitor C20 by means of the electric potential supplied from the rail RL1 through the resistors R23 and R18. Thus, unless the red and blue filaments provide a conductive path when power is initially applied at the input terminals 1',2', the IC U4 will not be turned on, the inverter will not oscillate, the IC U1 of the preconditioner circuit will not be supplied with power and no voltage will appear across the output terminals.

FIG. 12(*b*) illustrates another modification in which a capacitor C45 is connected across the base-emitter junction of switch Q5. The capacitor C45 forms a capacitor divider with C26. Though Q5 may initially turn on in to event of a missing lamp at ballast turn-on, C45 will begin the charge so that base-emitter voltage across Q5 drops, and turns Q5 off before a sufficient voltage is achieved across C20 to begin inverter oscillation.

DIMMING

Figure 13:
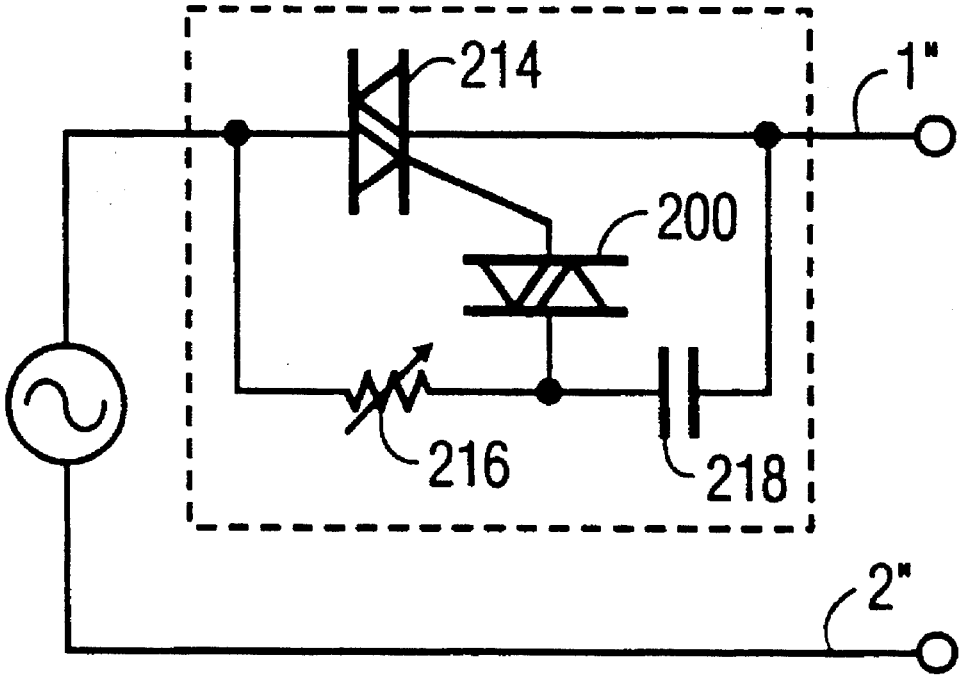
FIG. 13 is a circuit diagram of an external triac dimmer for use with the ballast according to the invention.
Figure 14A:
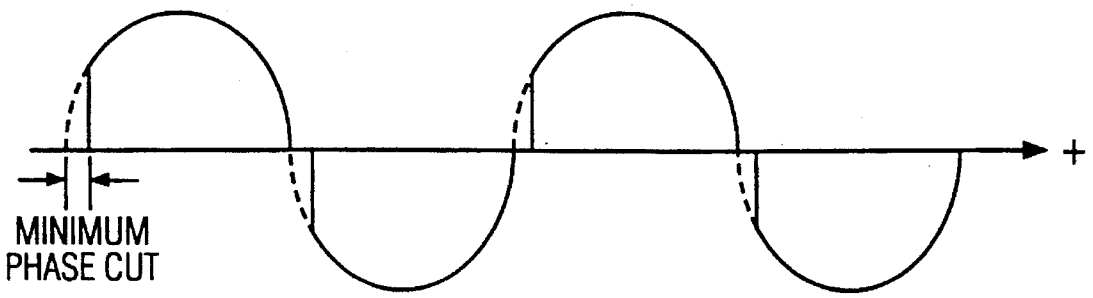
FIGS. 14(*a*)–(*b*) show phase angle controlled input waveforms from the triac dimmer of FIG. 13.
Figure 14B:
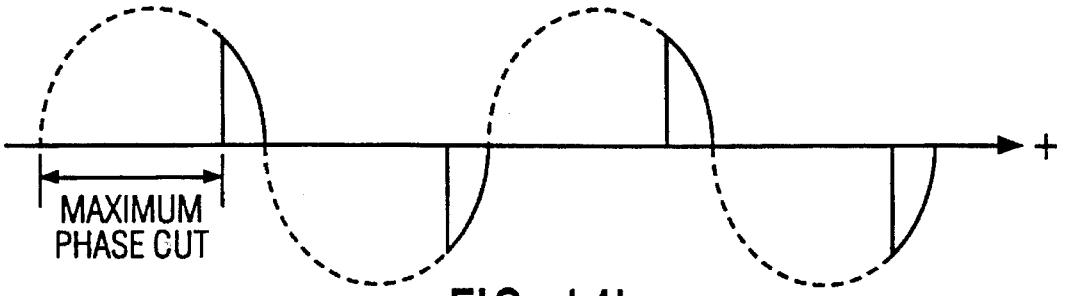
Figure 14C:
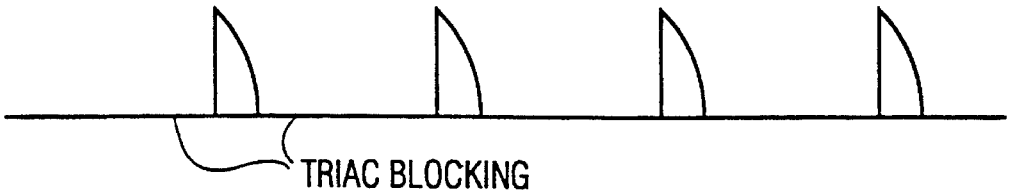
Figure 14D:
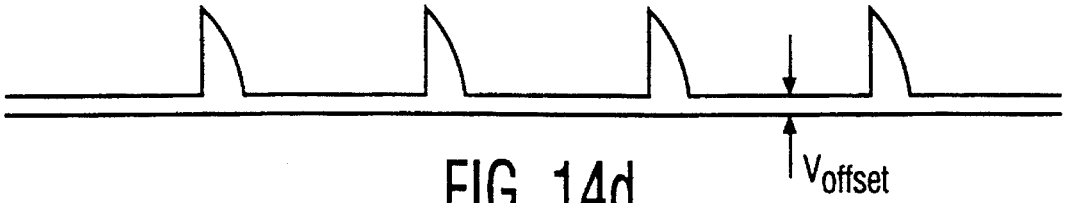

The above-described ballast includes circuitry especially adapted for use with a phase control dimmer. An exemplary phase control dimmer is shown in FIG. 13. The phase controller is provided with a triac connected in the power supply line 1". A series circuit consisting of a variable resistor 216 and a capacitor 218 is connected in parallel with the triac 214 for firing the triac 214 at an arbitrarily selected angle for phase conduction. A diac 200 is connected between a node of the variable resistor 216 and the capacitor 218, and the gate of the triac 14. By varying the resistance of the variable resistor 216, the phase controller supplies a voltage whose phase angle is controlled to the ballast input terminals 1',2'. Exemplary phase angle controlled waveforms are shown in FIGS. 14(*a*), 14(*b*). FIG. 14(*a*) shows a minimum phase cut (large conduction angle) corresponding to high light level and FIG. 14(*b*) shows a maximum phase cut angle (small conduction angle) corresponding to a minimum light level.

Input LC Filter and Pre-conditioner Offset

A distinctive feature of the ballast according to the invention is the design of the EMI filter and an offset feature of the pre-conditioner circuit. The LC filter provides EMI suppression and includes equally sized chokes L1 and L2 and capacitors C3 and C4. (FIG. 2(*a*)) In typical ballast applications, the LC filter is designed by selecting the appropriate pole frequency given by $f_p=1/(2\pi\sqrt{LC})$. Thus, the product of L and C determines the pole frequency. Generally, the inductance is selected to be small and the capacitance to be large so as to minimize the physical size of the inductors in the EMI filter. For a pole frequency of about 8 Khz, exemplary values are L=800 μH and C=0.5 ufd.

The proper operation of the external triac dimmer requires that the LC filter be sufficiently damped with the loading introduced by the pre-conditioner. Without proper loading,, oscillations occur in the EMI filter which can cause the triac in the triac dimmer to fire improperly. Inadequate damping of the filter also leads to excessive peak current on the chokes L1, L2 and over voltage (up to double the line peak) at the input of the inverter.

The loading required to prevent improper triac firing is reduced by selecting the LC filter with a relatively high characteristic impedance. The characteristic impedance is related to the $\sqrt{L/C}$, so contrary to the standard design philosophy, the inductance must be made large relative to the capacitance. Thus, in FIG. 2(*a*) inductors L1 and L2 are made relatively large and the capacitors C4 and C3 are relatively small. A small physical size for the inductors L1 and L2 is achieved by using a powdered iron core.

The EMI filter impedance is selected so that the peak overshoot of the EMI filter is less than the average value of the DC bus voltage at worst line conditions. This is critical to prevent triac misfiring, since overshoot can cause negative currents that will misfire the triac in the dimmer. Additionally, the pre-conditioner only operates properly to control the power factor and DC bus voltage when the peak of the rectified input is less than the DC bus voltage. Additionally, peak overshoots greater than the DC bus stress circuit components. In selecting the impedance, the "Q" of the EMI filter is given by $$Q=\frac{R}{\sqrt{L/C}}\ ;\text{and } k=\frac{1}{2Q}\ .$$

. The filter overshoot "Vovershoot" is given by the peak filter output voltage "Vopk"—peak input voltage "Vinpk", also given by $$\text{Vovershoot}=\text{Exp}\left[\frac{-\pi k}{\sqrt{1-k^2}}\right]=\text{Exp}\left[\frac{-\pi}{\sqrt{4Q^2-1}}\right.$$

In the Figure, L1 and L2 are each an E75-26 (Magnetics) core with an inductance of 2.3 mH and a saturation current higher than 2.0 A. The capacitance of C4 and C3 jointly was chosen to be 0.147 uF for EMI suppression, yielding a characteristic impedance ($\sqrt{L/C}$) of 188 ohms for the filter. R is the normal damping resistance presented by the pre-conditioner (for 60 W load and a 120 V line) and equals 240 in the present implementation. For the present filter, Q=1.28, yielding a Vovershoot of 0.26. For worst line design condition Vinpk=1.26×187 V(i.e. 120 Vt 10% ($\sqrt{2}$))=236 V. This is much less than the 280–300 V DC bus voltage. By contrast, for the standard filter given above, the characteristic impedance $\sqrt{L/C}$=40, Q=6, Vovershoot=77%, leading to Vopk of 330 V, well above the DC bus voltage. This leads to triac misfiring as will be illustrated in FIG. 15(*a*).

The damping is further improved by making the pre-conditioner slightly non-linear near the zero-crossing of the input voltage. The selected IC (Linfinity LX 1563) has this non-linearity which manifests itself as a relatively increased "on" time for the boost switch Q1 with lower voltages at the multiplier input, M_IN, pin.

The damping is made completely adequate, however, for all dimming levels only by making the pre-conditioner operate continuously and reliably even when the input voltage is very low or zero, as is the case when the triac of the triac dimmer is blocking. This is accomplished by providing an offset voltage to the MULT IN pin.

When the triac is blocking, the input voltage is zero for that portion of the 120 HZ rectified line voltage as illustrated in FIG. 14(*c*). The voltage across the input capacitor C4 should closely follow the rectified input voltage, i.e. it should mirror the waveform of FIG. 14(*c*). Without an offset voltage, the MULT IN pin would sense the (scaled) voltage across the capacitor C4. The switching of switch Q1 is determined by the peak inductor current in relation to the voltage at the MULT IN pin. Both the switching frequency and the duration of time that Q1 is conductive is greatest at the peak of the rectified DC voltage and decreases as this voltage decreases. When the voltage at the MULT IN pin is at or near zero, as is the case when the triac is blocking, the IC U1 tends to keep switch Q1 non-conductive to a much greater extent since the peak inductor current is kept small to follow the input or MULT IN voltage. For longer periods of Triac blocking there may even be periods when the switch is completely off. However, when the switch Q1 is non-conductive, there is no discharge path for the capacitor C4. Without a discharge path, the capacitor C4 cannot follow the rectified line voltage, in other words, the voltage across C4 will be held up.

By providing a small offset (125 mV) at the MULT IN pin of the IC U1, the total duration of time that the switch Q1 is kept conducting when the rectified voltage is at or near zero is increased and the switching is prevented from ever stopping. This allows sufficient discharging of the filler capacitor C4, allowing the voltage across the capacitor C4 to closely follow the rectified phase-controlled voltage. Thus, the preconditioner presents the LC EMI filter with a well damped resistive load during the entire line cycle and makes the triac dimmer fire uniformly.

Figure 15A:
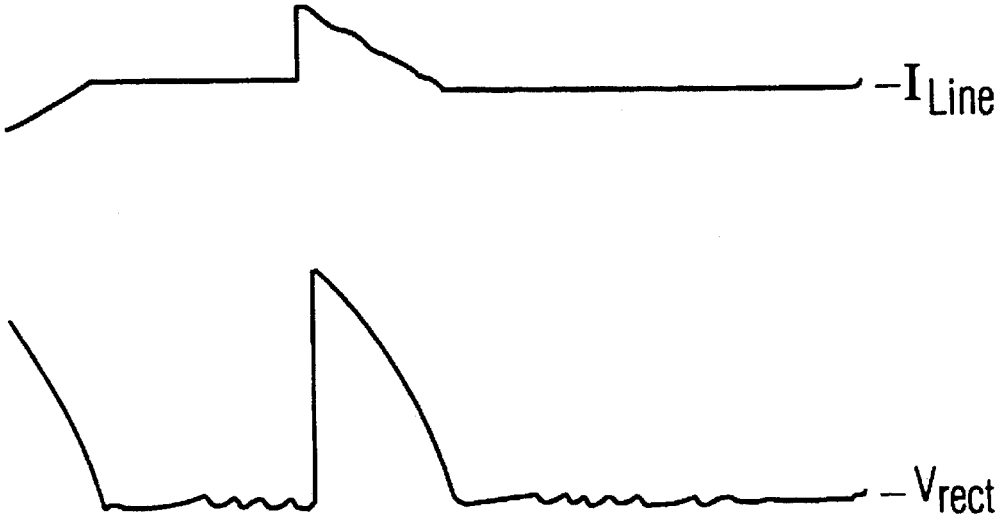
FIG. 15(*a*) illustrates the line current and rectified voltage in the case of triac misfiring.
Figure 15B:
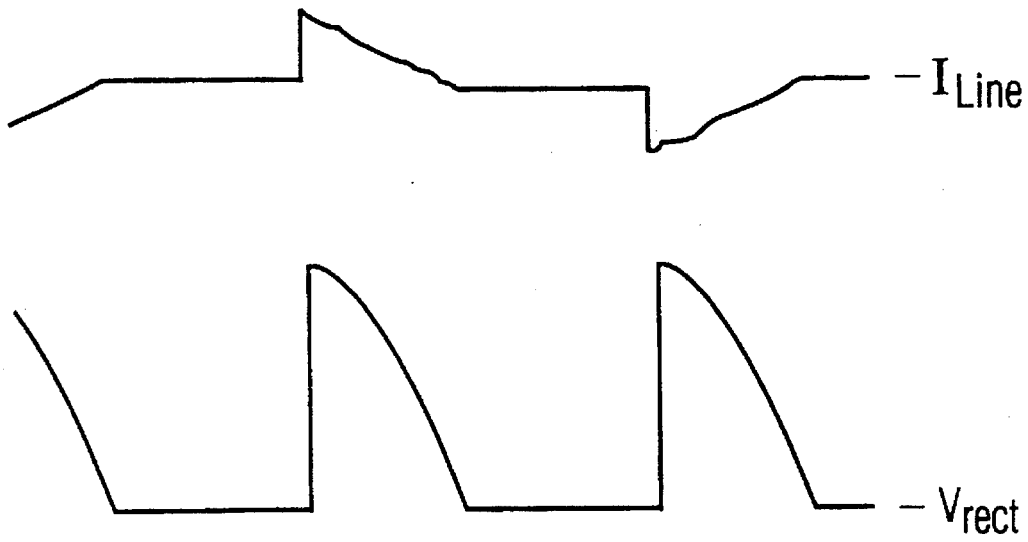

In the embodiment shown in FIG. 2(*a*), the offset voltage is accomplished by the resistor R8 of the pre-conditioner circuit. Whenever the inverter is operating, the inverter supplies a voltage to the $V_{in}$ pin. The resistor R8 bleeds off a small current to the junction between the resistors R5 and R6, which provides the offset voltage to the MULT IN pin. The voltage sensed at the MULT IN pin including the offset voltage is illustrated in FIG. 14(*d*). Thus, when the triac is blocking, the IC U1 will continue switching the switch Q1 at high frequency, presenting a resistive load to the capacitor C4. FIG. 15(*b*) illustrates the line current and rectified line voltage provided by the EMI filter and pre-conditioner according to the invention. Three cycles are illustrated, showing no triac misfiring. Without the use of this offset, the pre-conditioner does not load the LC filter for certain combinations of phase angle and lamp power levels when the triac is in the blocking state, which would occasionally cause the triac to misfire and cause flicker in the light output. FIG. 15(*a*) illustrates the same waveforms for an EMI filter with the conventionally selected impedance and without the pre-conditioner offset. Note that the triac has misfired resulting in blocking of the third cycle. The rectified line voltage also shows oscillation due to capacitive hold-up by the EMI filter.

The pre-conditioner offset is also significant for ensuring the accuracy of the dim signal from the interface circuit. As mentioned above, the voltage across capacitor C4 will be held-up and not mirror the phase angle input signal if it is not loaded properly. Such variations would appear in the dim signal output by the interface circuit and input to the DIM pin of the IC U4. Since the power control loop is the IC U4 is very fast, such variations would result in noticeable flicker.

CIRCUIT I: Dimming Interface

The dimming interface circuit (FIG. 2(*c*)) provides a dimming control signal for input to the DIM pin of the half-bridge driver U4 when a phase control dimmer is connected in the mains lines.

The dimming control signal output by the dimming interface circuit is the averaged value of the rectified line voltage. The averaged rectified line voltage decreases monotonically as the conduction angle of the AC input signal is decreased with a phase angle dimmer from a maximum to a minimum setting and thus is a good indicator of the setting of the dimmer. The average rectified line voltage is a function of conduction angle. Several factors must be taken into account in supplying the dim signal to the DIM pin of the controller U4.

As discussed previously, the voltage input at the DIM pin is compared to the averaged lamp power, represented by the voltage at the CRECT pin. The lamp control loop changes the FWD time until the difference between the voltage at the CRECT pin and at the DIM pin is reduced to nearly zero.

The lamp control loop is very fast, having a cycle time of about 16 μs. When the voltage at the DIM pin is changed, the control loop will close generally within about five iterations, so the lamp current is changed to the new level in about 100 μs. Consequently, any change in the dimming voltage input at the DIM pin results in a nearly instantaneous change in the lamp current. In other words, the lamp current will essentially mirror changes in the dim signal. Since the dim signal is derived from the 120 HZ rectifier output and the lamp current mirrors the dim signal, it should have a very low 120 Hz ripple component so as to maintain a good crest factor (i.e. the ratio of the peak to rms value of the lamp current). A good crest factor is important for maintaining the rated life of tubular fluorescent lamps, since a poor crest factor reduces the life of the electrodes. The rectified line voltage signal, however, has an AC ripple component which becomes larger in proportion to the average DC value of the rectified line voltage at lower conduction phase angles. To maintain a good crest factor, the rectified line voltage needs substantial filtering before being input to the DIM input of the IC U4. In the current embodiment the, desired crest factor is 1.6.

The response time of the dimming interface must also be fast enough to avoid power imbalances, which affects the bus voltage on RL1 across the buffer capacitor C1O, which should be maintained substantially constant (i.e., the average of the DC bus voltage staying within about +/−10%) for proper operation of the inverter. As mentioned above, the power control loop in IC U4 responds almost instantaneously to changes at the DIM input. The dim signal must react to changes in the input conduction angle with a speed at least of the same order of magnitude as that of the pre-conditioner. If the reaction time is slower, then when the conduction angle is decreased rapidly by the phase control dimmer, the controller U4 will lag behind the pre-conditioner. The controller U4 will still try to operate the lamps at a high light level, and the inverter will be drawing a relatively high power from the pre-conditioner, while the average input voltage to the pre-conditioner has already dropped. By selecting the interface to respond as fast or faster than the output of the pre-conditioner to increases in the conduction angle, this power inbalance situation is avoided. It should be noted that this power imbalance situation does not occur when the conduction angle is reduced since change in the dim interface, without the feedback loop of the preconditioner needing to respond.

Another consideration, important for the user, is that the change in light level should not noticeably lag behind changes in the setting of the phase control dimmer. In experiments conducted by the inventors, it was determined that the setting of dimmers now commercially available can be changed by a user from the highest to the lowest level, by movement of a slide controller for example, in about 50 ms.

The above requirements can be met with an interface circuit having a filter which responds fast (0–90%) in about 50 ms and which has an attenuation of about 30 dB at 120 Hz. The first factor satisfies the requirement for avoiding power imbalances while the latter provides the desired crest factor of 1.6.

Another function of the interface circuit is to scale the 120 HZ rectified line signal to provide a dimming voltage at the DIM input of the IC U4 which varies between a minimum level of 0.3 V and a maximum level of 3 V for the minimum and maximum conduction angles from the phase control dimmer.

The dim interface circuit is shown in FIG. 6 and includes a switch Q6 connected in series with resistors R1 and R2. The base of switch Q6 is connected to a 5 V output of the voltage regulator U3 and is always conductive when the inverter is oscillating. The interface circuit has a two-pole filter which includes a first RC filter formed by the resistors R1, R4, R27 and the capacitor C5 and a second RC filter formed by the resistor R17 and the capacitor C14.

When a phase cut signal such as shown in FIG. 14(*b*) is applied to the inputs 1',2' the voltage on rail RL1 is full wave rectified, with the phase cut preserved, as shown by the solid lines in FIG. 14(*c*). As previously discussed, the pre-conditioner offset makes the load look purely resistive to input capacitor C4, thereby preserving the phase cut information. Without the pre-conditioner, the capacitor C4 would hold up the input voltage, thereby essentially destroying the phase cut information.

The current through the resistor R1 is proportional to the rectified line voltage on rail RL1. The switch Q6 performs the scaling function. The voltage at the top of resistor R2 is constant at about 4.4 V and is equal to the 5 V supply from the regulator U3 minus the base-emitter voltage "Vbe" across the switch Q6. The current through the voltage divider network of the resistor R4 and the resistor R27 equals the current through the resistor R1 minus the fixed current through the resistor R2. Since the current through the resistor R2 is constant, the voltage at the top of the resistor R4 is scaled but proportional to the rectified line voltage on rail RL1. The voltage divider formed by the resistors R4 and R27 further scales the dim signal, which is applied to the DIM terminal of IC U4 via line 103. The values for the components of the interface circuit are listed in Appendix A. These values are selected for a phase angle dimmer having a conduction angle which varies between 60 and 150 degrees to provide the corresponding dimming signal voltages between 0.3 V and 3 V.

Figure 16A:
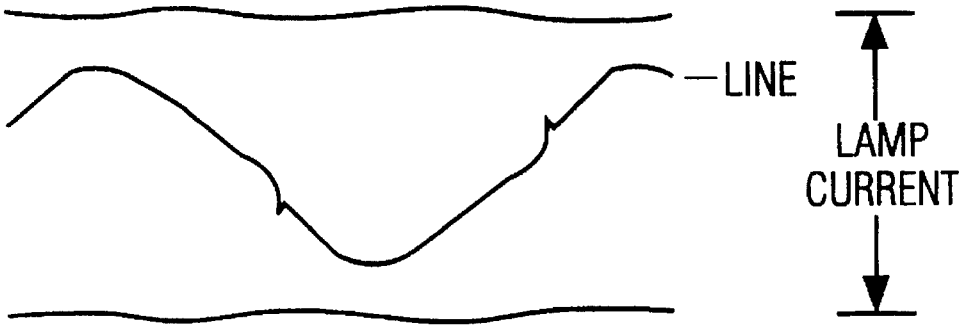
FIGS. 16(*a*)–16(*c*) illustrate the lamp current envelope for various conduction angles.
Figure 16B:
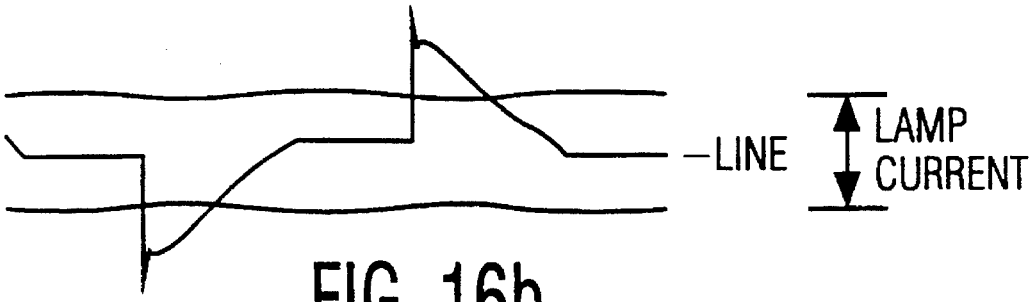
Figure 16C:
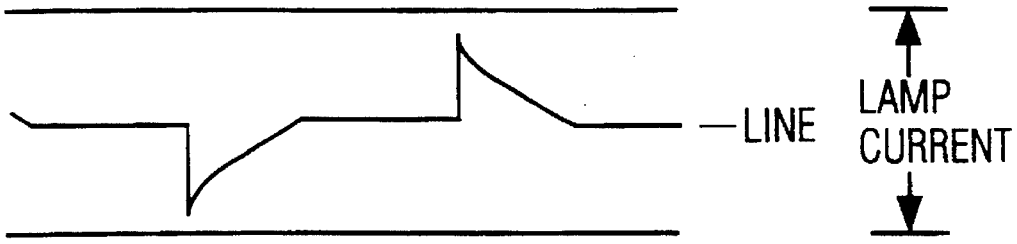

The diode D7 across the resistor R17 discharges the capacitor C14 when power is no longer applied to the input terminals 1', 2', thereby quickly bringing the DIM voltage down. FIGS. 16(*a*)–16(*c*) illustrate the resulting high frequency lamp current envelope for no dimming, and two successive dimming levels with increased conduction angle, the lamp current envelope remains substantially constant across the dimming range, and has low ripple. The crest factor for the illustrated lamp current is 1.6.

Appendix A lists the remaining circuit component values.

Figure 17:
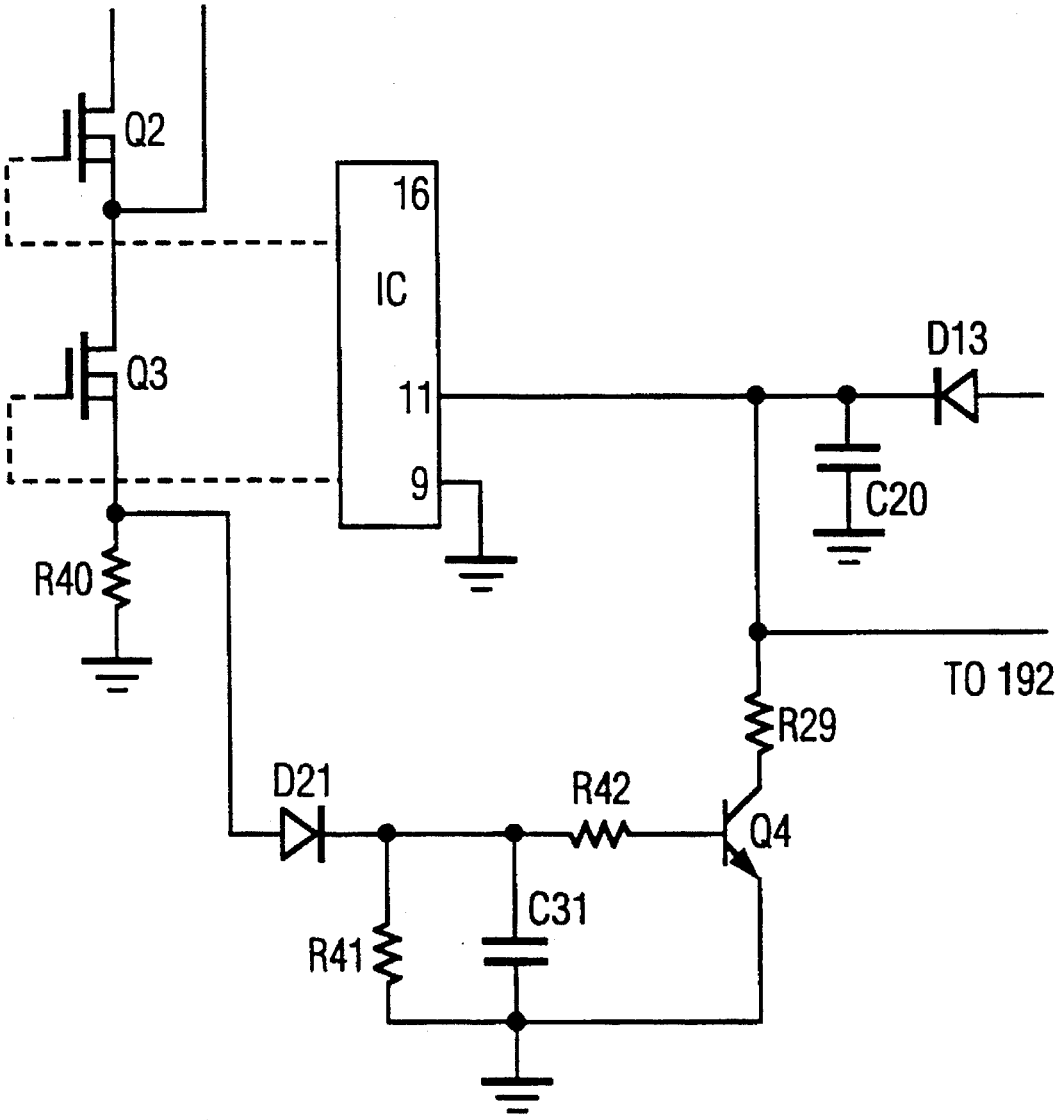
FIG. 17 shows a second embodiment of the interface filter, which includes a three pole filter.

FIG. 17 illustrates a second embodiment of the interface circuit. The phase controlled AC signal is derived from the AC side of the rectifier through the voltage divider formed by the resistors R50, R51.

The voltage signal at node V1 represents the average value of the rectified line voltage scaled down to signal voltage levels. (The divider is taken from the AC side of the bridge so as to slightly minimize the effect of capacitive hold-up of this voltage under light loading conditions).

The voltage V1 is scaled with a reference voltage V3, resistor R55, R56 and an Opamp 60 to generate voltage signal V2. This voltage is proportional to the lamp current required at the set phase angle. The scaling factors can be altered to give the desired range of dimming characteristics with the phase angle and to compensate for line variations. The three pole filter is formed by the three RC pairs R52, C52, R53, C53 and R54, C54.

A further advantage of the three pole filter is that the small amount of ripple voltage at node V1 helps in obtaining a better lamp current crest factor by compensating for the ripple on the boost capacitor (C10) voltage. With the given preconditioner topology, the ripple on the boost capacitor voltage lags the AC component of the rectified line voltage by approximately 90°. With the three-pole-filter, the ripple voltage at node V1 lags the AC component of the rectified line voltage by approximately 270°. Thus the ripple on the commanding dim signal is approximately 180° out of phase with the ripple on the bus voltage at the boost capacitor. This helps with the crest factor, especially at the current levels where the lamp tank network exhibits a high gain for the lamp current with respect to the 120 Hz ripple on the bus voltage.

This implementation gives a –3 dB frequency of about 9 Hz (0–90% response time of about 60 milliseconds for a pulse input) and –30 dB attenuation of the 120 Hz ripple for the averaging filter. The response time of 60 mSEC to reach 90% is about three times faster compared to a single pole filter giving the same 120 Hz attenuation.

Under non-dimming conditions, the disclosed ballast maintains a power factor <0.99, THD <10%, and a crest factor <1.6, so the circuit satisfies both the need for a triac dimmable ballast while also providing a high power factor ballast for non-dimming use. Additionally, the power factor remains high under all but the highest dimming (lowest light) conditions.

While there has been shown to be what are presently considered to be the preferred embodiments of the invention, it will be apparent to those of ordinary skill in the art that various modifications can be made without departing from the scope of the invention as defined by the appended claims. In particular, the various values given for various voltage stop or start levels, and filter impedances are selected for the illustrated implementation and will differ for different lamp applications. Accordingly, the disclosure is illustrive only and not limiting.

APPENDIX A

| | |
|---|---|
| R1 | 110K, ½ W, 1% |
| R2 | 22.0K, ¼ W, 1% |
| R4, R28 | 300K, ¼ W, 1% |
| R5 | 1M, ¼ W, 5% |
| R6 | 6.8K, ¼ W, 5% |
| R7, R32 | 30.1K, ¼ W, 1% |
| R8 | 680K, ¼ W, 5% |
| R9 | Jumper |
| R10 | 10, ¼ W, 6% |
| R11 | 22K, ¼ W, 5% |
| R12 | 330, ¼ W, 5% |
| R13 | 0.22, 1 W, 5% |
| R14 | 809K, ½ W, 1% |
| R15 | 768K, ¼ W, 1% |
| R16 | (used in uP version) |
| R17 | 100K, ¼ W, 5% |
| R18 | 1K, ¼ W, 5% |
| R19 | 5.1K, ¼ W, 1% |
| R20 | 200 Ohm, ¼ W, 1% |
| R21, R22 | 270, ¼ W, 5% |
| R23 | 22K, ½ W, 5% |
| R24 | 13.0K, ¼ W, 1% |
| R25 | 150 Ohm, ¼ W, 5% |
| R27 | 18.0K, ¼ W, 1% |
| R28 | 453K, ¼ W, 1% |
| R29 | 27, ¼ W, 5% |
| R30, R31 | 1.1K, ¼ W, 1% |
| R33 | 820, 2 W, 5% |
| R34 | 0.47, 1 W, 5% |
| R35 | 3.3, ¼ W, 1% |
| R36, R37, R38 | 470K, 5%, HV (Philips VR25) |
| C1, C2 | 3900P, 3 KV, 20% |
| C3 | 0.047 UF, 400 V, 20% |
| C4, C25 | 0.1 UF, 400 V, 20% |
| C5 | 0.22 uF, 100 V, 10% |
| C6, C8 | 0.001 UF, 50 V, 20% |
| C7, C13, C14 | 0.47 UF, 50 V, 10% |
| C10 | 47 UF, 450 V, 20% |
| C11 | used in uP version |

APPENDIX A-continued

| | |
|---|---|
| C12, C30, C17 | 0.1 UF 50 V, 20% |
| C15 | 0.12 UF, 50 V, 10% |
| C16 | 0.68 UF, 50 V, 10%, X7R |
| C18 | 2200 pF, 100 V, 20% |
| C19 | 82P, 50 V, 2% |
| C20 | 4.7 UF, 16 V, 20%, Elco |
| C21 | 1800P, 1 KV, 10% |
| C22 | 0.22 uF, 100 V, 20% |
| C23 | 0.0056 UF, 2 KV, 5% |
| C24 | 0.033 UF, 250 V, 5% |
| C26, C28 | 0.33 UF, 50 V, 10% |
| C27 | 0.68 UF, 50 V, 10% |
| C29 | 220 PF, 1 KV, 10% |
| C31 | 68 pF, 3 KV, 10% |
| D1, D2, D3, D4 | BYD-13G |
| D6, D11, D14, D16 | BYD33J |
| D7, D9, D10, D13, D17 | 1N4148 |
| D5 | 1N5253B (25 V, 5%, ½ W) |
| D12 | BZT03 C15 (15 V, 3%, 6W) |
| D18 | BAX14, 20 V2A50nS; |
| D19, D20 | BZX79, C43, ½ W, 5%, 43 V |
| Q1, Q2, Q3 | IRF 730 |
| Q4 | PN 2222 |
| Q5 | 2N 3904 |
| Q6 | 2N 5550 |
| V1 | S14K150, 150 V, 10% |
| F1 | 10A125 V, PN PICO |
| XL | used in uP version |
| U1 | LX1583 (Unfinity)/TDA4862 (Siemens) |
| U2 | used in uP version |
| U3 | 7BL05 |
| U4 | ALPHA (UB2010BA) |
| L1, L2 | N=196, #29, EE19 BOBBIN<br>E75-26 CORE |
| T1, T2 | 5X #34 Triple, #30<br>PC40-EF25, 92 MIL GAP |
| T3 | 3T8T, 0.36 Arms |
| T4 | 030 TRIPLE, #28 TRIPLE<br>12-PIN BOBBIN, PC40-EF25 |
| R50 | 680K Ohms |
| R51 | 680K Ohms |
| R52 | 30K Ohms |
| R53 | 39K Ohms |
| R54 | 39K Ohms |
| R55 | 100K Ohms |
| R56 | 100K Ohms |
| C52 | 0.1 μF |
| C53 | 0.1 μF |
| C54 | 0.1 μF |
| V3 - 1.85 V | |

We claim:

1. A gas discharge lamp ballast for use with a phase angle dimmer, said ballast comprising:

a pair of mains input terminals for receiving a phase angle controlled AC mains voltage;

ballasting means for providing electrical power to a gas discharge lamp, said ballasting means including (i) a DC input at which a substantially constant DC voltage is received, (ii) a dim input separate from said DC input for receiving a dimming signal and (iii) first control means for controlling the electrical power supplied to the gas discharge lamp at a level corresponding to a characteristic of the dimming signal;

power supply means connected to said mains input terminals for supplying the substantially constant DC voltage to said DC input of said ballasting means; and dim signal deriving means for deriving the dimming signal from the phase angle controlled AC mains voltage and for supplying the dimming signal to said dim input of said ballasting means, said dimming signal being independent of the DC voltage provided by said power supply means at said DC input of said ballasting means.

2. A ballast according to claim 1, wherein said dim signal deriving means supplies a dim signal having a characteristic which is monotonically related to the conduction angle of the phase controlled AC mains voltage.

3. A ballast according to claim 2, wherein said characteristic of the dim signal is the dim signal voltage.

4. A ballast according to claim 3, further comprising rectifier means connected to said mains input terminals for providing a full-wave rectified DC output voltage to said power supply means and said dim signal deriving means, and wherein the voltage of said dim signal provided by said dim signal deriving means equals the average value of the rectified DC voltage from said rectifier means.

5. A ballast according to claim 4, wherein said dim signal deriving means comprises a two-pole filter.

6. A ballast according to claim 4, wherein said dim signal deriving means comprises a three-pole filter.

7. A ballast according to claim 4, wherein:

said first control means is responsive to adjust the power to the gas discharge lamp for voltages at said dim input between and including a maximum dim input voltage and a minimum dim input voltage, and for use with a phase angle controller which adjusts the conduction angle of the mains voltage between a predetermined maximum conduction angle and a minimum conduction angle, said dim signal means includes means for scaling the rectified DC output voltage so that the dim signal voltage is substantially equal to the maximum dim input voltage for the maximum conduction angle and substantially equal to the minimum dim input voltage for the minimum conduction angle.

8. A ballast according to claim 4, wherein said dim signal deriving means includes means for scaling the voltage of the dim signal to a voltage range smaller than the voltage range of the DC rectified output voltage.

9. A lamp ballast according to claim 3, wherein said ballasting means includes (i) inverting means, connected to said DC inputs, said inverting means being adjustable by said first control means to control the power supplied to the discharge lamp, and (ii) said first control means comprises means for deriving a voltage signal representing the lamp power, and first feedback means for adjusting said inverter so that the voltage of the lamp power signal and said dimming signal are equal.

10. A lamp ballast according to claim 9, wherein:

said power supply means includes a second feedback means for sensing the DC supply voltage supplied by said power supply means for maintaining the DC supply voltage substantially constant, said second feedback means having a second characteristic response time;

said first feed back means has a first characteristic response time substantially faster than said second characteristics response time;

and said dim signal deriving means has a third characteristic response time, said third characteristic response time being faster than said second response time of said power supply means and slower than said first response time of said ballasting means.

11. A lamp ballast according to claim 1, wherein:

said power supply means includes feedback means which senses the DC supply voltage supplied by said power supply means for maintaining said DC supply voltage substantially constant, said feedback means having a characteristic response time; and said means for deriving said dimming signal has a characteristic response time which is at least as fast, to the same order of magnitude, as said characteristic response time of said power supply means.

12. A ballast according to claim 11, wherein said dim signal deriving means has a characteristic response time which is faster than said characteristic response time of said power supply means.

13. A ballast for use with a phase angle dimmer, said ballast comprising:

mains input terminals for connection to a common line and a hot dimmed line from a phase angle dimmer, the hot dimmed line carrying an AC mains voltage having a conduction phase angle controlled by the phase angle dimmer, said mains voltage having a mains frequency;

rectifier means having a rectifier output, said rectifier being connected to said mains input terminals for providing a full wave rectified DC output voltage at said rectifier output, said rectified output voltage including the conduction phase angle of the phase controlled AC mains voltage;

filtering means for suppressing high frequency harmonics from entering the mains supply, said filtering means including a filter capacitor charged by said rectified output voltage;

power supply means for providing a DC supply voltage, said power supply means including an input receptive of said rectified output voltage, said power supply means including (i) a controllable switching means switchable between a conductive and a non-conductive switching state, one of said switching states providing a discharge path for said filter capacitor, and (ii) control means for controlling the switching state of said switching means, said control means switching said switching state of said switching means at frequencies substantially higher than said mains frequency to control the DC supply voltage;

ballasting means for providing electrical power to a gas discharge lamp, said ballasting means including (i) a DC input receptive of the DC output voltage of said power supply means, (ii) a dim input separate from said DC input for receiving a dimming signal and (iii) means for controlling the electrical power supplied to the gas discharge lamp at a level corresponding to a characteristic of the dimming signal; and dim signal deriving means for deriving the dimming signal from the phase controlled rectified DC output voltage and for supplying the dimming signal to said dim input of said ballasting means, said dimming signal being independent of the DC supply voltage provided at said DC inputs of said ballasting means by said power supply means, and wherein said control means of said power supply means includes means for maintaining said high frequency switching of said switching means so as to discharge said filter capacitor when said phase controlled rectified output voltage is at or near zero, thereby to alleviate capacitive hold-up of the rectified output voltage by said filter capacitor.

14. A ballast according to claim 13, wherein said dim signal means supplies a dim signal having a characteristic which is monotonically related to the conduction angle of the phase controlled AC mains voltage.

15. A ballast according to claim 13, wherein said dim signal deriving means derives a voltage signal equal to the average value of the voltage of the phase controlled rectified output voltage.

16. A ballast according to claim 15, wherein said ballast means controls the lamp current such that the lamp current has a ripple substantially the same as that of the dim signal, and said dim signal deriving means comprises means for attenuating the ripple of the rectified output voltage by at least about 30 dB at 120 Hz.

17. A ballast according to claim 16, wherein said dim signal deriving means comprises a two-pole filter.

18. A ballast according to claim 16, wherein said dim signal deriving means comprises a three-pole filter.

19. A ballast for use with a phase angle dimmer, said ballast comprising:

only two mains input terminals for connection to a common line and a hot dimmed line from a phase angle dimmer, the hot dimmed line carrying an AC mains voltage having a conduction phase angle controlled by the phase angle dimmer;

a full bridge rectifier connected to the two mains input terminals for providing a full wave rectified DC output voltage, the rectified DC output voltage including the conduction phase angle of the phase controlled AC mains voltage and having a peak voltage;

a pre-conditioner circuit connected to the full-bridge rectifier, said pre-conditioner circuit including an up converter for providing a DC supply voltage at a level higher than the peak voltage of the rectified DC output voltage from said full-bridge rectifier;

an inverter circuit receptive of the DC supply voltage from said pre-conditioner circuit, said inverter converting the DC supply voltage from said preconditioner to a high frequency AC voltage having a frequency substantially greater than the frequency of the AC mains supply;

a resonant tank output circuit receptive of the high frequency AC inverter output voltage, said output circuit having lamp connection terminals for connection to a gas discharge lamp, said output circuit providing a substantially sinusoidal lamp current to a gas discharge lamp connected at said lamp terminals;

a control circuit connected to the inverter for controlling the AC inverter output voltage, said control circuit having (i) means for receiving a dimming signal separate from the DC output of the pre-conditioner circuit, (ii) means for sensing the power supplied to the gas discharge lamp, and (iii) means for adjusting the AC inverter output frequency fed to said resonant tank output circuit to thereby control the electrical power supplied to the gas discharge lamp at a level corresponding to the voltage of the dimming signal; and a dimming interface circuit receptive of the phase-controlled rectified DC output voltage from said full-bridge rectifier, said dimming interface circuit including means for outputting a dimming signal having a voltage substantially equal to the average value of the rectified line voltage.

20. A ballast according to claim 19, wherein:

said control circuit is responsive to adjust the power to the gas discharge lamp for voltages at said dim input between and including a maximum dim input voltage and a minimum dim input voltage, and for use with a phase angle controller which adjusts the conduction angle of the mains voltage between a predetermined maximum conduction angle and a minimum conduction angle, and dimming interface circuit includes means for scaling the rectified DC output voltage so that the dimming signal voltage is substantially equal to the maximum dim input voltage for the maximum conduction angle and substantially equal to the minimum dim input voltage for the minimum conduction angle.

21. A ballast according to claim 20, wherein said dimming interface attenuates the rectified DC output voltage by at least about 30 dB at 120 Hz.

22. A ballast according to claim 19, further comprising an EMI filter having a filter capacitor charged by the rectified DC output voltage, and said up-converter includes (i) controllable switch switchable between a conductive and a non-conductive state at frequencies substantially higher than the frequency of the rectified DC output voltage, the conductive state of said switch providing a discharge path for said filter capacitor, (ii) a control circuit for controlling the switching of said controllable switch to maintain a substantially constant DC output voltage, said control circuit including means for maintaining the switching of said switch into the conductive state during periods when the rectified DC output voltage is at or near zero, thereby to alleviate capacitive hold-up of said rectified output voltage.

23. A ballast according to claim 19, wherein said preconditioner circuit maintains said DC voltage at a substantially constant level.

24. A lamp ballast according to claim 23, wherein:

said pre-conditioner circuit includes feedback means which senses the DC voltage output by said up-converter for maintaining said DC pre-conditioner output voltage substantially constant, said feedback means having a characteristic response time; and said dimming interface circuit having a characteristic response time which is at least as fast, to the same order of magnitude, as said characteristic response time of said pre-conditioner circuit.

25. A ballast according to claim 24, wherein said dim interface circuit has a characteristic response time which is faster than said characteristic response time of said pre-conditioner circuit.

26. A ballast according to claim 25, wherein said control circuit controls said inverter such that the lamp current has a ripple substantially the same as that of the dim signal, and said dim interface circuit comprises means for attenuating the ripple of the rectified output voltage by at least about 30 dB at 120 Hz.

27. A ballast according to claim 26, wherein said dim interface circuit comprises a two-pole filter.

28. A ballast according to claim 27, wherein said dim interface circuit comprises a three-pole filter.

* * * * *

UNITED STATES PATENT AND TRADEMARK OFFICE

CERTIFICATE OF CORRECTION

PATENT NO. : 5,559,395

DATED : September 24, 1996

INVENTOR(S) : Venkitasubrahmanian et al.

It is certified that error appears in the above-identified patent and that said Letters Patent is hereby corrected as shown below:

On the title page item [75],

In the inventors, add Gert Bruning and Paul Veldman.

Signed and Sealed this

Twenty-sixth Day of May, 1998

Bruce Lehman

*Attest:*

BRUCE LEHMAN

*Attesting Officer*

*Commissioner of Patents and Trademarks*